US011812785B2

(12) United States Patent
Blackmon et al.

(10) Patent No.: US 11,812,785 B2
(45) Date of Patent: Nov. 14, 2023

(54) CAPSULES INCLUDING INTERNAL HEATERS, HEAT-NOT-BURN (HNB) AEROSOL-GENERATING DEVICES, AND METHODS OF GENERATING AN AEROSOL

(71) Applicant: Altria Client Services LLC, Richmond, VA (US)

(72) Inventors: Zack Blackmon, Williamsburg, VA (US); Patrick Good, Richmond, VA (US); Rangaraj S. Sundar, Midlothian, VA (US); Jarrett Keen, Richmond, VA (US); Eric Hawes, Midlothian, VA (US); Dean Twite, London (GB); Guy Moseley, Cambridgeshire (GB); Niall Gallagher, Cambridge (GB)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 434 days.

(21) Appl. No.: 16/909,131

(22) Filed: Jun. 23, 2020

(65) Prior Publication Data

US 2021/0392951 A1 Dec. 23, 2021

(51) Int. Cl.
*A24F 40/20* (2020.01)
*A24F 40/46* (2020.01)

(52) U.S. Cl.
CPC ..... *A24F 40/20* (2020.01); *A24F 40/46* (2020.01)

(58) Field of Classification Search
CPC ..... A24F 40/20; A24F 40/42; A24F 40/46
See application file for complete search history.

(56) References Cited

U.S. PATENT DOCUMENTS

| | | | | |
|---|---|---|---|---|
| 10,219,543 | B2 | 3/2019 | Gill et al. | |
| 10,271,578 | B2 | 4/2019 | John et al. | |
| 2017/0055584 | A1 | 3/2017 | Blandino et al. | |
| 2017/0164657 | A1 * | 6/2017 | Batista | A24F 40/42 |

(Continued)

FOREIGN PATENT DOCUMENTS

| | | | | |
|---|---|---|---|---|
| CN | 108354232 | A | 8/2018 | |
| WO | WO-2017068095 | A1 * | 4/2017 | A24B 15/167 |
| WO | WO-2020181358 | A1 * | 9/2020 | A24B 15/12 |

OTHER PUBLICATIONS

International Search Report and Written Opinion for PCT/US2021/022355 dated Aug. 19, 2021.

(Continued)

*Primary Examiner* — Hae Moon Hyeon
*Assistant Examiner* — Thang H Nguyen
(74) *Attorney, Agent, or Firm* — Harness, Dickey & Pierce, P.L.C.

(57) ABSTRACT

A capsule for a heat-not-burn (HNB) aerosol-generating device may include a housing and a heater within the housing. The housing has interior surfaces defining a chamber configured to hold an aerosol-forming substrate. In addition, the housing has exterior surfaces constituting a first face, an opposing second face, and a side face of the capsule. The first face and the second face of the capsule are permeable to an aerosol. The heater has a first end section, an intermediate section, and a second end section. The first end section and the second end section of the heater may be external segments constituting parts of the side face of the capsule. The intermediate section of the heater is an internal segment disposed within the chamber of the housing.

21 Claims, 28 Drawing Sheets

(56) References Cited

U.S. PATENT DOCUMENTS

| | | | | |
|---|---|---|---|---|
| 2017/0181472 | A1* | 6/2017 | Batista | A24F 40/46 |
| 2018/0235279 | A1 | 8/2018 | Wilke et al. | |
| 2018/0295885 | A1 | 10/2018 | Rojo-Calderon et al. | |
| 2019/0001087 | A1* | 1/2019 | Davidson | A24F 40/485 |
| 2019/0208823 | A1* | 7/2019 | Raich | A61K 36/185 |
| 2020/0037669 | A1* | 2/2020 | Bowen | A24F 40/46 |
| 2020/0229507 | A1* | 7/2020 | Flora | H05B 3/44 |
| 2022/0183348 | A1* | 6/2022 | Selby | A24D 3/17 |

OTHER PUBLICATIONS

International Preliminary Report on Patentability dated Jan. 5, 2023 in related international patent application No. PCT/US2021/022355.

* cited by examiner

CAPSULES INCLUDING INTERNAL HEATERS, HEAT-NOT-BURN (HNB) AEROSOL-GENERATING DEVICES, AND METHODS OF GENERATING AN AEROSOL

BACKGROUND

Field

The present disclosure relates to capsules, heat-not-burn (HNB) aerosol-generating devices, and methods of generating an aerosol without involving a substantial pyrolysis of the aerosol-forming substrate.

Description of Related Art

Some electronic devices are configured to heat a plant material to a temperature that is sufficient to release constituents of the plant material while keeping the temperature below a combustion point of the plant material so as to avoid any substantial pyrolysis of the plant material. Such devices may be referred to as aerosol-generating devices (e.g., heat-not-burn aerosol-generating devices), and the plant material heated may be tobacco. In some instances, the plant material may be introduced directly into a heating chamber of an aerosol-generating device. In other instances, the plant material may be pre-packaged in individual containers to facilitate insertion and removal from an aerosol-generating device.

SUMMARY

At least one embodiment relates to a capsule for a heat-not-burn (HNB) aerosol-generating device. In an example embodiment, the capsule may include a housing and a heater within the housing. The housing has interior surfaces defining a chamber configured to hold an aerosol-forming substrate. In addition, the housing has exterior surfaces constituting a first face, an opposing second face, and a side face of the capsule. The first face and the second face of the capsule are permeable to an aerosol. The heater has a first end section, an intermediate section, and a second end section. The first end section and the second end section of the heater are external segments constituting parts of the side face of the capsule. The intermediate section of the heater is an internal segment disposed within the chamber of the housing.

At least one embodiment relates to a heat-not-burn (HNB) aerosol-generating device. In an example embodiment, the aerosol-generating device may include a capsule and a device body. The capsule contains an aerosol-forming substrate. In addition, the capsule includes a first permeable face, an opposing second permeable face, and a side face. The device body may include a heating pad configured to heat the aerosol-forming substrate within the capsule via conduction to generate an aerosol. In such an instance, the device body may be configured to receive the capsule such that the heating pad engages and covers the first permeable face or the second permeable face of the capsule.

At least one embodiment relates to a method of generating an aerosol. In an example embodiment, the method may include engaging a capsule between a first pad and a second pad. The capsule contains an aerosol-forming substrate and includes a first permeable face, an opposing second permeable face, and a side face. The method may additionally include heating the aerosol-forming substrate with at least one of the first pad or the second pad such that the aerosol generated passes through at least one of the first pad or the second pad.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
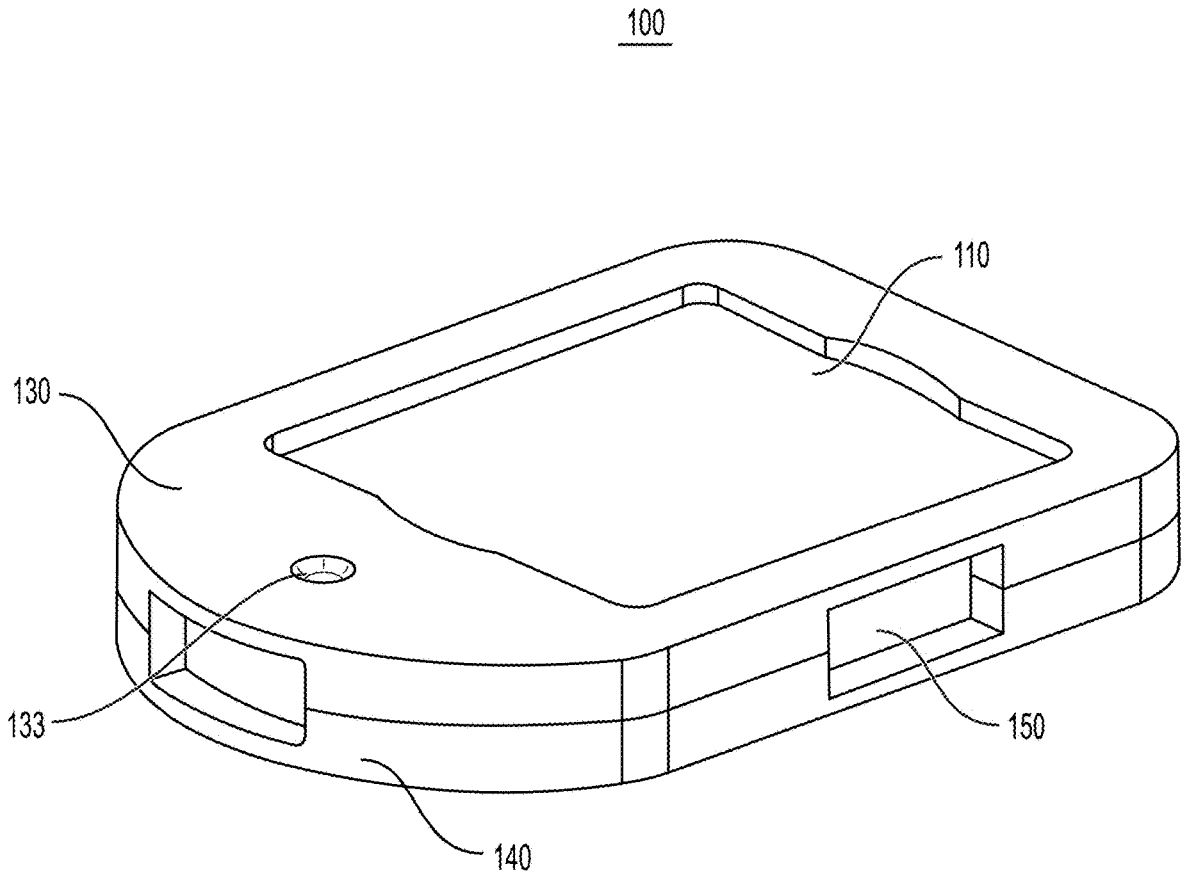
FIG. 1 is a perspective view of a first side of a capsule for an aerosol-generating device according to an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," "attached to," "adjacent to," or "covering" another element or layer, it may be directly on, connected to, coupled to, attached to, adjacent to or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the terms "about" or "substantially" are used in this specification in connection with a numerical value, it is intended that the associated numerical value includes a manufacturing or operational tolerance (e.g., ±10%) around the stated numerical value. Moreover, when the terms "generally" or "substantially" are used in connection with geometric shapes, it is intended that precision of the geometric shape is not required but that latitude for the shape is within the scope of the disclosure. Furthermore, regardless of whether numerical values or shapes are modified as "about," "generally," or "substantially," it will be understood that these values and shapes should be construed as including a manufacturing or operational tolerance (e.g., ±10%) around the stated numerical values or shapes.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Hardware may be implemented using processing or control circuitry such as, but not limited to, one or more processors, one or more Central Processing Units (CPUs), one or more microcontrollers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUs), one or more microprocessors, one or more Application Specific Integrated Circuits (ASICs), or any other device or devices capable of responding to and executing instructions in a defined manner.

Figure 2:
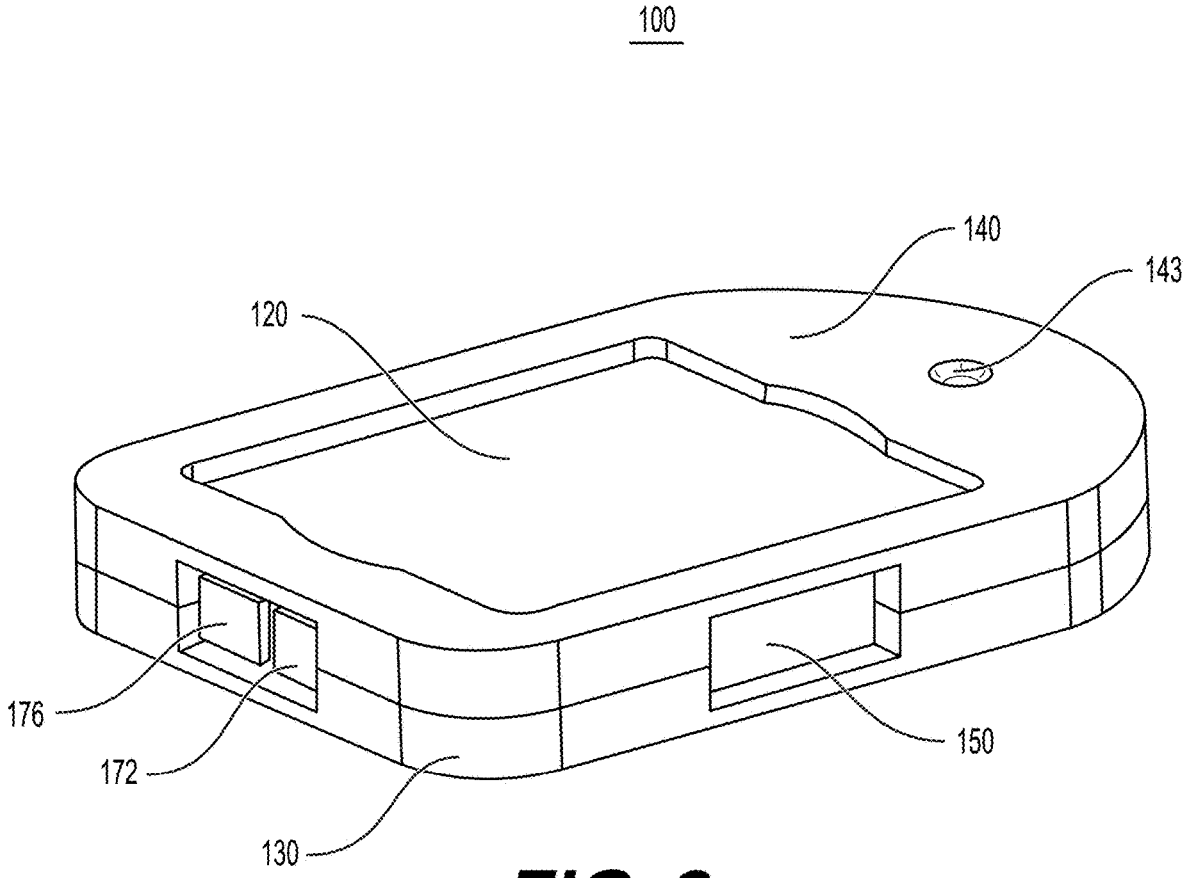
FIG. 2 is a perspective view of an opposing second side of the capsule of FIG. 1.

FIG. 1 is a perspective view of a first side of a capsule for an aerosol-generating device according to an example embodiment. FIG. 2 is a perspective view of an opposing second side of the capsule of FIG. 1. Referring to FIGS. 1-2, the capsule 100 may be configured to be received within an aerosol-generating device (e.g., heat-not-burn aerosol-generating device). In the drawings, the capsule 100 has a laminar structure and a generally planar form. The proximal end of the capsule 100 may have a curved proximal edge, and the opposing distal end may have a linear distal edge. In addition, a pair of linear side edges may connect the curved proximal edge and the linear distal edge. The pair of linear side edges may be parallel to each other. Furthermore, the junctions of the linear side edges with the linear distal edge may be in the form of rounded corners.

Although the capsule 100 is shown in the figures as resembling a rectangle with a semicircular end (e.g., elongated semicircle, semi-obround), it should be understood that other configurations may be employed. For instance, the shape may be circular such that the capsule 100 has a disk-like appearance. In another instance, the shape of the capsule 100 may be elliptical or racetrack-like. In other instances, the capsule 100 may have a polygonal shape (regular or irregular), including a triangle, a rectangle (e.g., square), a pentagon, a hexagon, a heptagon, or an octagon. The laminar structure and generally planar form of the capsule 100 may facilitate stacking so as to allow a plurality of capsules to be stored in an aerosol-generating device or other receptacle for dispensing a new capsule or receiving a depleted capsule. In an example embodiment, the capsule 100 has a thickness between 1-4 mm (e.g., between 1-2 mm).

The capsule 100 may include a housing and a heater 170 (e.g., FIG. 5) within the housing. The housing of the capsule 100 has interior surfaces defining a chamber configured to hold an aerosol-forming substrate 160 (e.g., FIG. 5). In addition, the housing of the capsule 100 has exterior surfaces constituting a first face, an opposing second face, and a side face of the capsule 100. The first face and the second face of the capsule 100 may be permeable to an aerosol. The side face of the capsule 100 is between the first face and the second face. The side face may be regarded as a periphery of the capsule 100.

Figure 3:
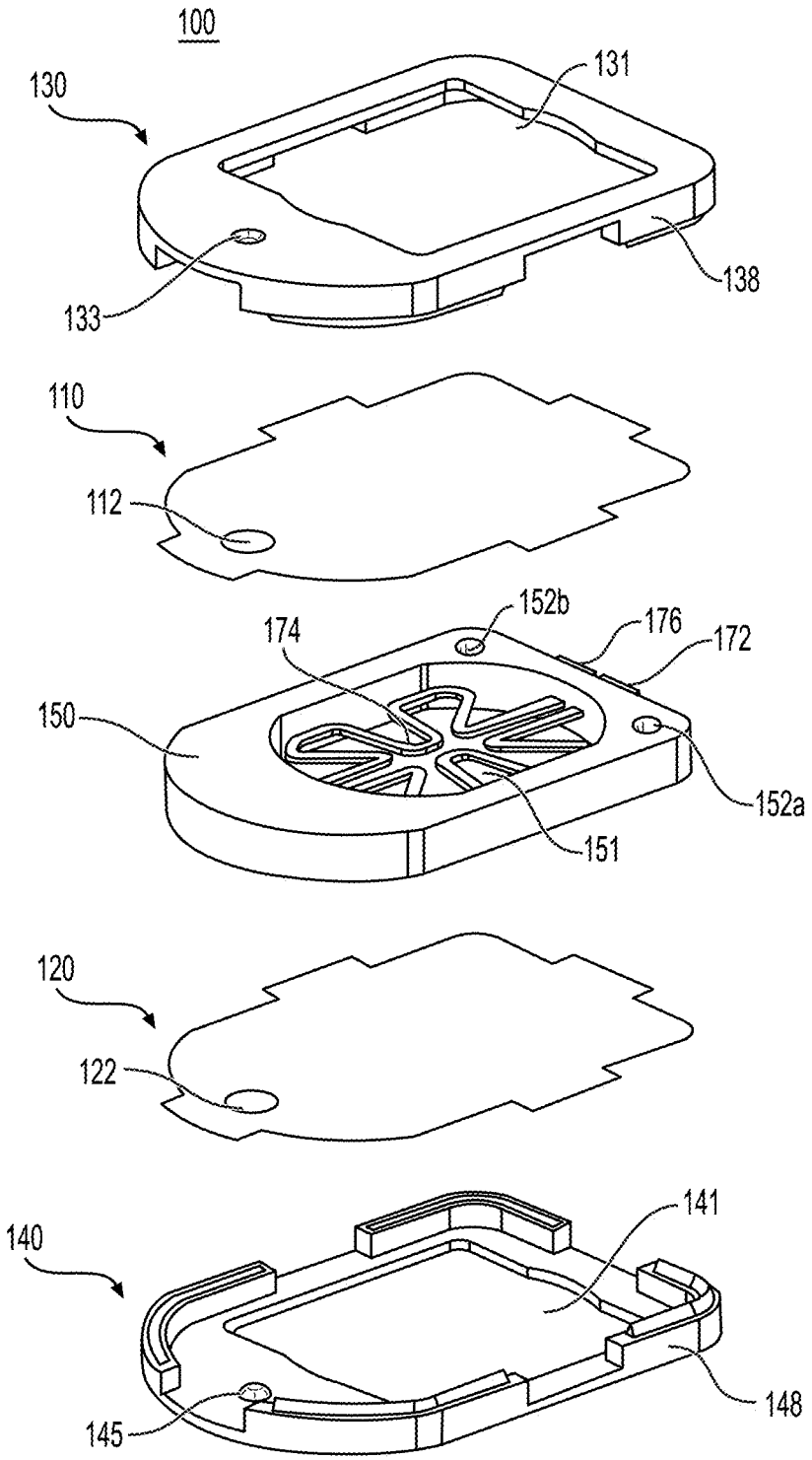
FIG. 3 is an exploded view of the capsule of FIG. 1.

The housing of the capsule 100 includes a first frame 130 and a second frame 140 (e.g., FIG. 3). The first frame 130 and the second frame 140 may be of the same shape and size (e.g., based on a plan view) and aligned such that the outer sidewalls are substantially flush with each other, although example embodiments are not limited thereto. The first frame 130 and the second frame 140 may be formed of a suitable polymer, such as polyether ether ketone (PEEK), liquid crystal polymer (LCP), and/or ultra-high molecular weight polyethylene (UHMWPE). The first frame 130 and the second frame 140 may be connected via a welded arrangement.

A first permeable structure 110 is secured and exposed by the first frame 130. Similarly, a second permeable structure 120 is secured and exposed by the second frame 140. As will be discussed in more detail herein, a third frame 150 is disposed between the first permeable structure 110 and the second permeable structure 120 (as well as between the first frame 130 and the second frame 140). The capsule 100 is configured to hold an aerosol-forming substrate 160, which may be within the third frame 150 and between the first permeable structure 110 and the second permeable structure 120. A first concavity 133 (e.g., first dimpled portion) in the first frame 130 and a second concavity 143 (e.g., second dimpled portion) in the second frame 140 may be from an injection molding process. In this regard, the size, location, and/or shape of the first concavity 133 and the second concavity 143 may differ (or may be absent altogether) depending on the fabrication technique.

The first permeable structure 110 and the second permeable structure 120 may be in a form of a mesh sheet, a perforated sheet, or a combination thereof. For instance, both the first permeable structure 110 and the second permeable structure 120 may be in a form of a mesh sheet. In another instance, both the first permeable structure 110 and the second permeable structure 120 may be in a form of a perforated sheet (e.g., 80, 100, or 250 mesh equivalent). The perforated sheet may be one that is perforated mechanically or chemically (e.g., via photochemical machining/etching). In yet another instance, one of the first permeable structure 110 or the second permeable structure 120 may be in a form of a mesh sheet, while the other of the first permeable structure 110 or the second permeable structure 120 may be in a form of a perforated sheet. The first permeable structure 110 and the second permeable structure 120 (as well as the first frame 130 and the second frame 140) may be substantially the same size based on a plan view (e.g., ±10% of a given dimension).

As shown in FIG. 1, the combination of the exposed surface of the first permeable structure 110 and the adjacent (e.g., substantially coplanar/parallel) surface the first frame 130 may be regarded as the first face of the capsule 100. Similarly, as shown in FIG. 2, the combination of the exposed surface of the second permeable structure 120 and the adjacent (e.g., substantially coplanar/parallel) surface of the second frame 140 may be regarded as the second face of the capsule 100. In one instance, the first face, the second face, or both may include perforated sheets. In another instance, the first face, the second face, or both may include mesh sheets. In yet another instance, one of the first face or the second face may include a perforated sheet, while the other of the first face or the second face may include a mesh sheet.

As noted supra and as will be discussed herein in more detail, a heater 170 (e.g., FIG. 5) may be disposed within the capsule 100 to heat the aerosol-forming substrate 160. The heater 170 may include, inter alia, a first end section 172 and a second end section 176 configured to receive an electric current from a power source during an activation of the heater 170. When the heater 170 is activated, the temperature of the aerosol-forming substrate 160 may increase, and an aerosol may be generated and released through the first permeable structure 110 and/or the second permeable structure 120 of the capsule 100.

As shown in FIGS. 1-2, the combination of the exposed surfaces of the third frame 150 and the adjacent sidewalls of the first frame 130 and the second frame 140 may be regarded as the side face of the capsule 100. Additionally, the first end section 172 and the second end section 176 may be external segments of the heater 170 that also constitute parts of the side face of the capsule 100. The outward-facing surfaces of the first end section 172 and the second end section 176 of the heater 170 may be coplanar, although example embodiments are not limited thereto.

As discussed herein, an aerosol-forming substrate is a material or combination of materials that may yield an aerosol. An aerosol relates to the matter generated or output by the devices disclosed, claimed, and equivalents thereof. The material may include a compound (e.g., nicotine, cannabinoid), wherein an aerosol including the compound is produced when the material is heated. The heating may be below the combustion temperature so as to produce an aerosol without involving a substantial pyrolysis of the aerosol-forming substrate or the substantial generation of combustion byproducts (if any). Thus, in an example embodiment, pyrolysis does not occur during the heating and resulting production of aerosol. In other instances, there may be some pyrolysis and combustion byproducts, but the extent may be considered relatively minor and/or merely incidental.

The aerosol-forming substrate may be a fibrous material. For instance, the fibrous material may be a botanical material. The fibrous material is configured to release a compound when heated. The compound may be a naturally occurring constituent of the fibrous material. For instance, the fibrous material may be plant material such as tobacco, and the compound released may be nicotine. The term "tobacco" includes any tobacco plant material including tobacco leaf, tobacco plug, reconstituted tobacco, compressed tobacco, shaped tobacco, or powder tobacco, and combinations thereof from one or more species of tobacco plants, such as *Nicotiana rustica* and *Nicotiana tabacum*.

In some example embodiments, the tobacco material may include material from any member of the genus *Nicotiana*. In addition, the tobacco material may include a blend of two or more different tobacco varieties. Examples of suitable types of tobacco materials that may be used include, but are not limited to, flue-cured tobacco, Burley tobacco, Dark tobacco, Maryland tobacco, Oriental tobacco, rare tobacco, specialty tobacco, blends thereof, and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. In some example embodiments, the tobacco material is in the form of a substantially dry tobacco mass. Furthermore, in some instances, the tobacco material may be mixed and/or combined with at least one of propylene glycol, glycerin, sub-combinations thereof, or combinations thereof.

The compound may also be a naturally occurring constituent of a medicinal plant that has a medically-accepted therapeutic effect. For instance, the medicinal plant may be a cannabis plant, and the compound may be a cannabinoid. Cannabinoids interact with receptors in the body to produce a wide range of effects. As a result, cannabinoids have been used for a variety of medicinal purposes (e.g., treatment of pain, nausea, epilepsy, psychiatric disorders). The fibrous material may include the leaf and/or flower material from one or more species of cannabis plants such as *Cannabis sativa, Cannabis indica*, and *Cannabis ruderalis*. In some instances, the fibrous material is a mixture of 60-80% (e.g., 70%) *Cannabis sativa* and 20-40% (e.g., 30%) *Cannabis indica*.

Examples of cannabinoids include tetrahydrocannabinolic acid (THCA), tetrahydrocannabinol (THC), cannabidiolic acid (CBDA), cannabidiol (CBD), cannabinol (CBN), cannabicyclol (CBL), cannabichromene (CBC), and cannabigerol (CBG). Tetrahydrocannabinolic acid (THCA) is a precursor of tetrahydrocannabinol (THC), while cannabidiolic acid (CBDA) is precursor of cannabidiol (CBD). Tetrahydrocannabinolic acid (THCA) and cannabidiolic acid (CBDA) may be converted to tetrahydrocannabinol (THC) and cannabidiol (CBD), respectively, via heating. In an example embodiment, heat from a heater (e.g., heater 170 shown in FIG. 5) may cause decarboxylation so as to convert the tetrahydrocannabinolic acid (THCA) in the capsule 100 to tetrahydrocannabinol (THC), and/or to convert the cannabidiolic acid (CBDA) in the capsule 100 to cannabidiol (CBD).

In instances where both tetrahydrocannabinolic acid (THCA) and tetrahydrocannabinol (THC) are present in the capsule 100, the decarboxylation and resulting conversion will cause a decrease in tetrahydrocannabinolic acid (THCA) and an increase in tetrahydrocannabinol (THC). At least 50% (e.g., at least 87%) of the tetrahydrocannabinolic acid (THCA) may be converted to tetrahydrocannabinol (THC) during the heating of the capsule 100. Similarly, in instances where both cannabidiolic acid (CBDA) and cannabidiol (CBD) are present in the capsule 100, the decarboxylation and resulting conversion will cause a decrease in cannabidiolic acid (CBDA) and an increase in cannabidiol (CBD). At least 50% (e.g., at least 87%) of the cannabidiolic acid (CBDA) may be converted to cannabidiol (CBD) during the heating of the capsule 100.

Furthermore, the compound may be or may additionally include a non-naturally occurring additive that is subsequently introduced into the fibrous material. In one instance, the fibrous material may include a synthetic material. In another instance, the fibrous material may include a natural material such as a cellulose material (e.g., non-tobacco and/or non-cannabis material). In either instance, the compound introduced may include nicotine, cannabinoids, and/or flavorants. The flavorants may be from natural sources, such as plant extracts (e.g., tobacco extract, cannabis extract), and/or artificial sources. In yet another instance, when the fibrous material includes tobacco and/or cannabis, the compound may be or may additionally include one or more flavorants (e.g., menthol, mint, vanilla). Thus, the compound within the aerosol-forming substrate may include naturally occurring constituents and/or non-naturally occurring additives. In this regard, it should be understood that existing levels of the naturally occurring constituents of the aerosol-forming substrate may be increased through supplementation. For example, the existing levels of nicotine in a quantity of tobacco may be increased through supplementation with an extract containing nicotine. Similarly, the existing levels of one or more cannabinoids in a quantity of cannabis may be increased through supplementation with an extract containing such cannabinoids.

Figure 4:
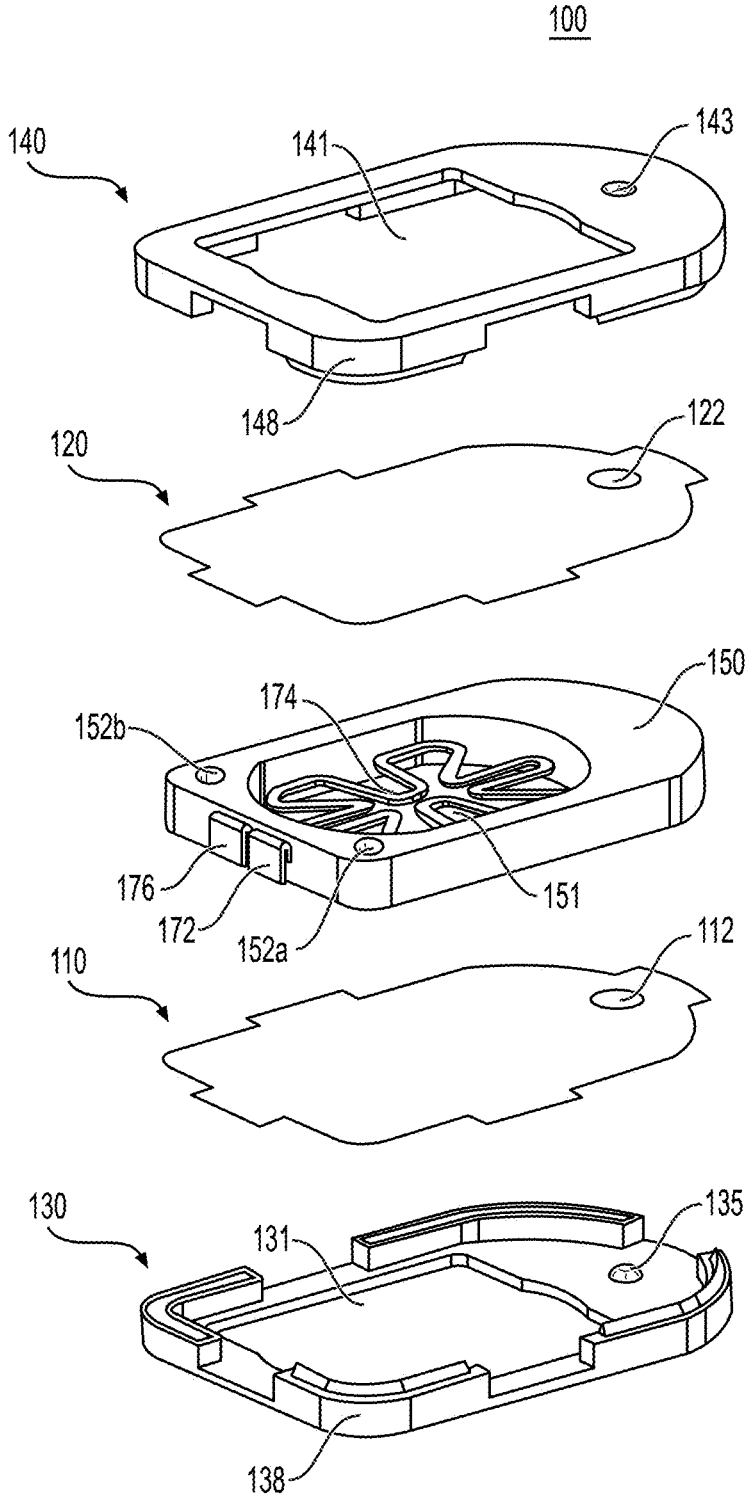
FIG. 4 is an exploded view of the capsule of FIG. 2.

FIG. 3 is an exploded view of the capsule of FIG. 1. FIG. 4 is an exploded view of the capsule of FIG. 2. Referring to FIGS. 3-4, the first frame 130 has a first interior face and a first exterior face. In addition, the first frame 130 defines a first opening 131. In an example embodiment, the sidewall of the first opening 131 has opposing linear sections and, optionally, opposing curved sections, wherein one curved section may be adjacent to the proximal end of the first frame 130, and the other curved section may be adjacent to the opposing distal end of the first frame 130. The first permeable structure 110 may be secured to the first interior face of the first frame 130 so as to be exposed by the first opening 131. From a difference perspective, the first permeable structure 110 may also be regarded as covering the first opening 131. Furthermore, the first permeable structure 110 may define a first aperture 112. The first aperture 112 may be positioned and sized so as to accommodate the first convexity 135 when the first permeable structure 110 is secured to the first frame 130.

The second frame 140 has a second interior face and a second exterior face. In addition, the second frame 140 defines a second opening 141. In an example embodiment, the sidewall of the second opening 141 has opposing linear sections and, optionally, opposing curved sections, wherein one curved section may be adjacent to the proximal end of the second frame 140, and the other curved section may be adjacent to the opposing distal end of the second frame 140. The second permeable structure 120 may be secured to the second interior face of the second frame 140 so as to be exposed by the second opening 141. From a different perspective, the second permeable structure 120 may also be regarded as covering the second opening 141. The size and shape of the second opening 141 may correspond to (e.g., mirror) the size and shape of the first opening 131. Furthermore, the second permeable structure 120 may define a second aperture 122. The second aperture 122 may be positioned and sized so as to accommodate the second convexity 145 when the second permeable structure 120 is secured to the second frame 140.

The third frame 150 defines a cavity 151 (e.g., FIG. 5) configured to receive an aerosol-forming substrate 160. The combination of the sidewall of the cavity 151 and the interior surfaces of the first permeable structure 110 and the second permeable structure 120 (which cover the cavity 151) may be regarded as defining a chamber. In an example embodiment, the sidewall of the cavity 151 has opposing linear sections and opposing curved sections, wherein one curved section is adjacent to the proximal end of the third frame 150, and the other curved section is adjacent to the opposing distal end of the third frame 150. The third frame 150 may be substantially the same size as the first permeable structure 110 and the second permeable structure 120 based on a plan view (e.g., ±10% of a given dimension). The third frame 150 may also define apertures 152*a* and 152*b* adjacent to its distal end. In addition to the materials of construction for the first frame 130 and the second frame 140, the third frame 150 may also be formed of other suitable materials, such as ceramic, sintered glass, and/or consolidated fibers (e.g., cardboard).

A heater 170 is configured to extend through the third frame 150 and into the cavity 151. Additionally, the heater 170 may be regarded as being supported by the third frame 150. The heater 170 includes a first end section 172, an intermediate section 174, and a second end section 176. The first end section 172 and the second end section 176 of the heater 170 are external segments that also constitute parts of the side face of the capsule 100. The intermediate section 174 of the heater 170 is an internal segment disposed within the capsule 100 (e.g., within the chamber of the housing containing the aerosol-forming substrate 160). The first end section 172, the intermediate section 174, and the second end section 176 of the heater 170 are sections of a continuous structure. In an example embodiment, the intermediate section 174 of the heater 170 has a planar and winding form.

The aerosol-forming substrate 160 may be disposed within the cavity 151 of the third frame 150 so as to be on both sides of the intermediate section 174 of the heater 170. In one instance, the aerosol-forming substrate 160 may be in a consolidated form (e.g., sheet, pallet, tablet) that is configured to maintain its shape so as to allow the aerosol-forming substrate 160 to be placed in a unified manner within the cavity 151 of the third frame 150. In such an instance, one mass of the aerosol-forming substrate 160 may be disposed on one side of the intermediate section 174 of the heater 170, while another mass of the aerosol-forming substrate 160 may be disposed on the other side of the intermediate section 174 of the heater 170 (e.g., so as to substantially fill the cavity 151 of the third frame 150 and sandwich/embed the intermediate section 174 of the heater 170 in between). Alternatively, the aerosol-forming substrate 160 may be in a loose form (e.g., particles, fibers, grounds, fragments, shreds) that does not have a set shape but rather is configured to take on the shape of the cavity 151 of the third frame 150 when introduced.

The first permeable structure 110 and the second permeable structure 120 may be secured to the first frame 130 and the second frame 140, respectively, via a variety of attachment techniques. For instance, the attachment technique may involve injection molding (e.g., insert molding, over molding). In another instance, the attachment technique may involve ultrasonic welding. In other instances, the attachment technique may involve an adhesive (e.g., tape, glue) that has been deemed food-safe or otherwise acceptable by a regulatory authority. Alternatively, in lieu of a separate attachment technique, the first permeable structure 110 and the second permeable structure 120 may be clamped against the third frame 150 (or otherwise constrained) by the first frame 130 and the second frame 140, respectively.

The first frame 130 includes at least one first connector protruding from the first interior face of the first frame 130. The at least one first connector of the first frame 130 may be in a form of a first connector 138. In an example embodiment, the first connector 138 may extend along an edge of the first interior face of the first frame 130 in a form a ridge (e.g., first ridge). The ridge may define a trench extending along its entire length so as to resemble an elevated trench or a recessed/furrowed ridge. In addition or in the alternative, the ridge may have a tapered ridgeline and, as a result, may be referred to as a tapered ridge. Although the first connector 138 is shown as being separated into a plurality of discrete structures (e.g., four discrete structures), it should be understood that example embodiments are not limited thereto. For instance, alternatively, the first connector 138 may be a single, continuous structure extending along the edge so as to completely surround the first interior face of the first frame 130.

Similarly, the second frame 140 includes at least one second connector protruding from the second interior face of the second frame 140. The at least one second connector of the second frame 140 may be in a form of a second connector 148. The second connector 148 of the second frame 140 and the first connector 138 of the first frame 130 are complementary structures configured to mate with each other. In an example embodiment, the second connector 148 may extend along an edge of the second interior face of the second frame 140 in a form a ridge (e.g., second ridge). The ridge may define a trench extending along its entire length so as to resemble an elevated trench or a recessed/furrowed ridge. In addition or in the alternative, the ridge may have a tapered ridgeline and, as a result, may be referred to as a tapered ridge. Although the second connector 148 is shown as being separated into a plurality of discrete structures (e.g., four discrete structures), it should be understood that example embodiments are not limited thereto. For instance, alternatively, the second connector 148 may be a single, continuous structure extending along the periphery so as to completely surround the second interior face of the second frame 140.

In the non-limiting embodiment illustrated in FIGS. 3-4 where the first connector 138 of the first frame 130 is separated into four discrete structures, two of the structures may be elevated trenches, while the other two structures may be tapered ridges. Conversely, the second connector 148 of the second frame 140 may be separated into four discrete structures, wherein two of the structures are tapered ridges, while the other two structures are elevated trenches. The mixed set of elevated trenches and tapered ridges of the first frame 130 are configured to mate with the mixed set of tapered ridges and elevated trenches, respectively, of the second frame 140 during the assembly of the capsule 100. It should be understood that various combinations of elevated trenches and the tapered ridges are possible for the first frame 130 and the second frame 140. Furthermore, each of the first permeable structure 110 and the second permeable structure 120 may have tab-like extensions (e.g., four tab-like extensions) disposed between the discrete structures of the first connector 138 and the second connector 148, respectively, when the capsule 100 is assembled.

A tapered ridge of the first connector 138 and/or the second connector 148 may have a shoulder portion and an inclined portion that rises from the shoulder portion to form a tapered ridgeline. The tapered ridgeline may function as an energy director during assembly (e.g., to facilitate welding). A corresponding elevated trench of the first connector 138 and/or the second connector 148 may have a rim portion and a trench bottom. As shown in FIGS. 3-4, the trench bottom of the elevated trench may be a planar bottom. Alternatively, the trench bottom of the elevated trench may be a V-shaped bottom. In an example embodiment of a connection between the first frame 130 and the second frame 140, the inclined portion of a tapered ridge is configured to contact the trench bottom of a corresponding elevated trench, while the shoulder portion of the tapered ridge interfaces with the rim portion of the elevated trench. Thus, the engagement surfaces of the first connector 138 and the second connector 148 may be inversely or complementarily configured to facilitate mating.

When the mixed set of elevated trenches and tapered ridges of each frame are grouped such that the elevated trenches are on one linear side edge while the tapered ridges are on the other linear side edge, as shown in FIGS. 3-4, the first frame 130 and the second frame 140 may be identical parts. In such an instance, orienting the first frame 130 and the second frame 140 to face each other for mating will result in a complementary arrangement. As a result, one part may be used interchangeably as the first frame 130 or the second frame 140, thus simplifying the method of manufacturing.

To assemble the capsule 100, the first frame 130 may be connected to the second frame 140 after an aerosol-forming substrate 160 is disposed within the cavity 151 of the third frame 150 (e.g., so as to be on both sides of the intermediate section 174 of the heater 170). In such an instance, the third frame 150 will be sandwiched between the first permeable structure 110 and the second permeable structure 120 when the first frame 130 is connected to the second frame 140. During assembly, the at least one first connector of the first frame 130 is configured to engage with the at least one second connector of the second frame 140 to form at least one connection (e.g., four connections). For instance, an elevated trench (and/or tapered ridge) of the first connector 138 is configured to mate with a corresponding tapered ridge (and/or elevated trench) of the second connector 148. In addition, the joinder between the first connector 138 of the first frame 130 and the second connector 148 of the second frame 140 may be achieved via a welded arrangement (e.g., ultrasonic welding). Furthermore, the outer sidewall of the first frame 130 may be substantially flush with the outer sidewall of the second frame 140 when the capsule 100 is assembled, although example embodiments are not limited thereto. Once assembled, the capsule 100 is difficult or impracticable to open without damaging the connectors, the frames, and/or other aspects of the capsule 100. As a result, the capsule 100 is relatively tamper-proof against unauthorized actions by third parties.

The capsule 100 has been described as including, inter alia, a first frame 130 that is separate from a second frame 140. Alternatively, in some instances, the first frame 130 and the second frame 140 may be fabricated as a single structure that is configured to fold during assembly such that the first connector 138 engages with the second connector 148. For example, the first frame 130 and the second frame 140 may resemble a clamshell structure, wherein the linear distal edge of the first frame 130 is connected to the linear distal edge of the second frame 140 with an integral section of reduced thickness that functions as a fold line. In another example, a linear side edge of the first frame 130 may be connected to a linear side edge of the second frame 140 with an integral section of reduced thickness that functions as a fold line. With a clamshell structure, it should be understood that one or more connections (e.g., along the fold line) may be omitted from the capsule 100.

Figure 5:
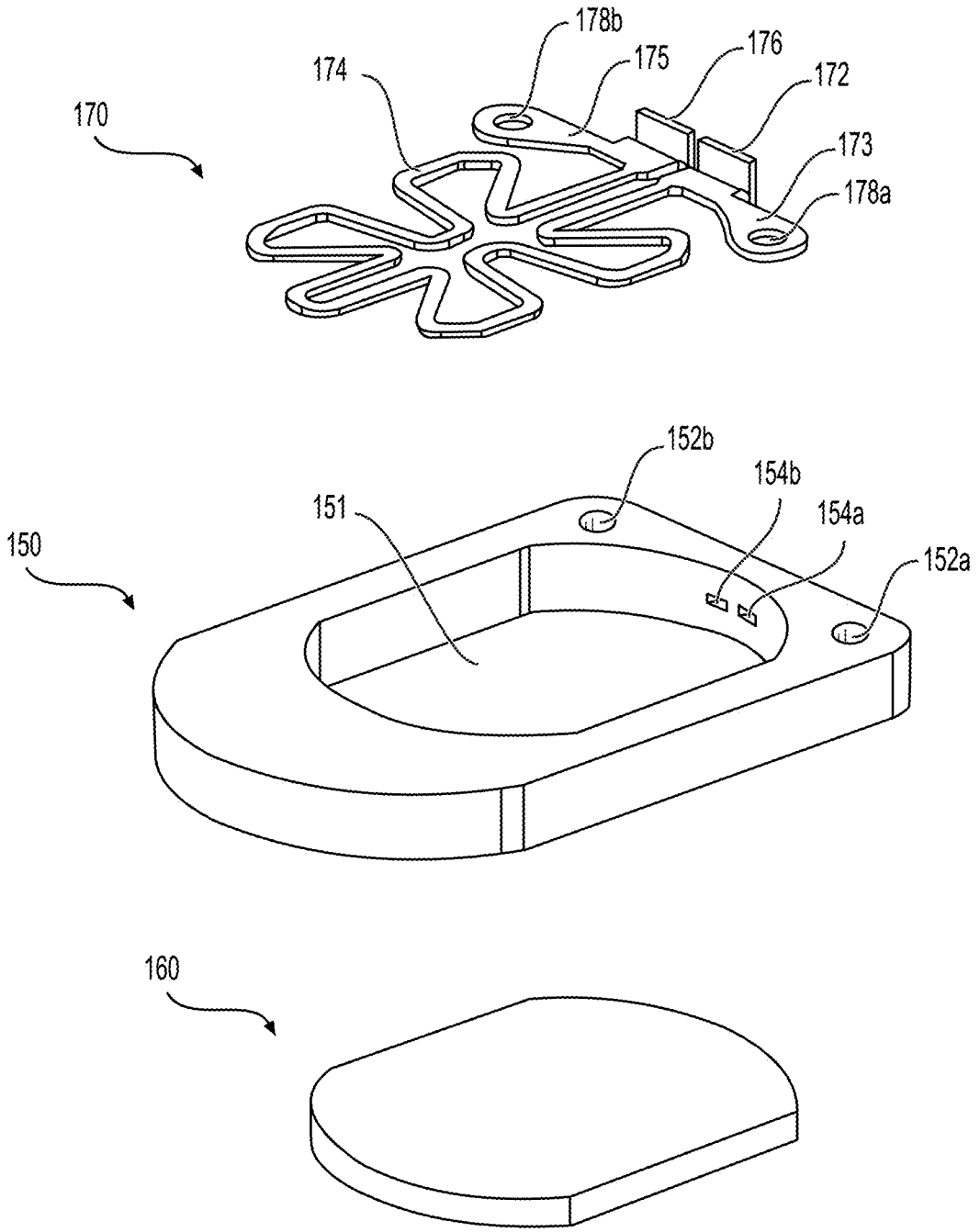
FIG. 5 is an isolated view of the heater and the third frame in FIG. 3.
Figure 6:
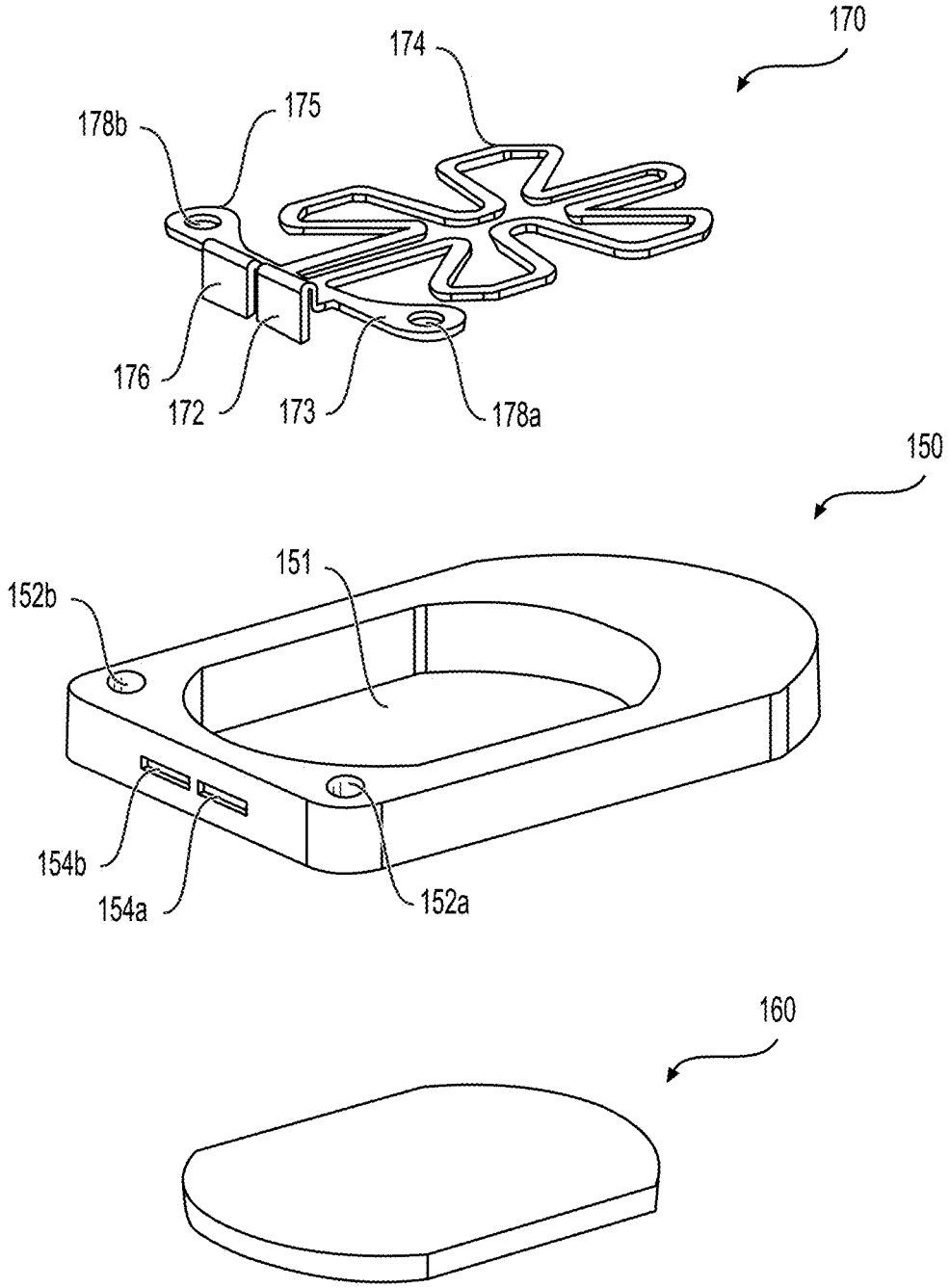
FIG. 6 is an isolated view of the heater and the third frame in FIG. 4.

FIG. 5 is an isolated view of the heater and the third frame in FIG. 3. FIG. 6 is an isolated view of the heater and the third frame in FIG. 4. Referring to FIGS. 5-6, the heater 170 includes a first end section 172, a first arm portion 173, an intermediate section 174, a second arm portion 175, and a second end section 176. The first arm portion 173 and the second arm portion 175 may define apertures 178*a* and 178*b*, respectively, although example embodiments are not limited thereto. In one instance, the first end section 172 and the second end section 176 may be coplanar. Additionally, the first arm portion 173, the intermediate section 174, and the second arm portion 175 may be coplanar. In such an instance, the plane corresponding to the first end section 172 and the second end section 176 may be orthogonal to the plane corresponding to the first arm portion 173, the intermediate section 174, and the second arm portion 175. Furthermore, the heater 170 may be symmetrical about its longitudinal axis. The longitudinal axis of the heater 170 may be within the plane corresponding to the first arm portion 173, the intermediate section 174, and the second arm portion 175 so as to bisect the intermediate section 174 and extend (e.g., equidistantly) between the first end section 172 and the second end section 176.

In an example embodiment, the heater 170 is configured to undergo Joule heating (which is also known as ohmic/resistive heating) upon the application of an electric current thereto. Stated in more detail, the heater 170 may be formed of one or more conductors and configured to produce heat when an electric current passes therethrough. The electric current may be supplied to the first end section 172 and the second end section 176 of the heater 170 from a power source (e.g., battery) within the aerosol-generating device. Suitable conductors for the heater 170 include an iron-based alloy (e.g., stainless steel, iron aluminides), a nickel-based alloy (e.g., nichrome), and/or a ceramic (e.g., ceramic coated with metal). The intermediate section 174 of the heater 170 may have a thickness of about 0.1-0.3 mm (e.g., 0.15-0.25 mm) and a resistance of about 0.5-2.5 Ohms (e.g., 1-2 Ohms).

The electric current from the power source within the aerosol-generating device may be transmitted via electrodes configured to electrically contact the first end section 172 and the second end section 176 of the heater 170 when the capsule 100 is inserted into the aerosol-generating device. In a non-limiting embodiment, the electrodes may be spring-loaded to enhance an engagement with the heater 170 of the capsule 100. The spring-loading of the electrodes may be in a direction that is along a longitudinal axis of the heater 170 and orthogonal to the plane corresponding to the first end section 172 and the second end section 176. In addition to or in lieu of the spring-loading, the movement (e.g., engagement, release) of the electrodes may be achieved by mechanical actuation. Furthermore, the supply of the electric current from the aerosol-generating device to the capsule 100 may be a manual operation (e.g., button-activated) or an automatic operation (e.g., puff-activated).

The third frame 150 may be a monolithic structure. In an example embodiment, the heater 170 may be embedded within the third frame 150. For instance, the heater 170 may extend through the third frame 150 via slots 154*a* and 154*b*. In such an instance, the intermediate section 174 of the heater 170 is within the cavity 151 of the third frame 150, while the first arm portion 173 and the second arm portion 175 of the heater 170 are within the distal portion of the third frame 150, and the first end section 172 and the second end section 176 of the heater 170 are outside the cavity 151 and against the distal sidewall of the third frame 150. Additionally, the apertures 178*a* and 178*b* of the heater 170 may be aligned with the apertures 152*a* and 152*b*, respectively, of the third frame 150. The apertures 178*a* and 178*b* may already be formed (e.g., pre-formed) in the heater 170 before the heater 170 is embedded within the third frame 150.

Alternatively, the apertures 178*a* and 178*b* in the heater 170 may be subsequently formed together with the apertures 152*a* and 152*b* in the third frame 150 after the heater 170 is embedded within the third frame 150. The embedding of the heater 170 within the third frame 150 may be achieved via injection molding.

The intermediate section 174 of the heater 170 may be in the form of a pattern that spans a majority of the open area in the cavity 151. For instance, the pattern may be such that the intermediate section 174 of the heater 170 meanders or undulates around the center of the cavity 151 of the third frame 150. In such an instance, the intermediate section 174 of the heater 170 may alternate between extending toward the center of the cavity 151 and away from the center of the cavity 151. As illustrated in FIGS. 5-6, the undulations of the intermediate section 174 of the heater 170 may be in the form of five protuberances (e.g., lobes, wings, fingers) that do not contact the sidewall of the cavity 151 of the third frame 150, although example embodiments are not limited thereto.

Figure 7:
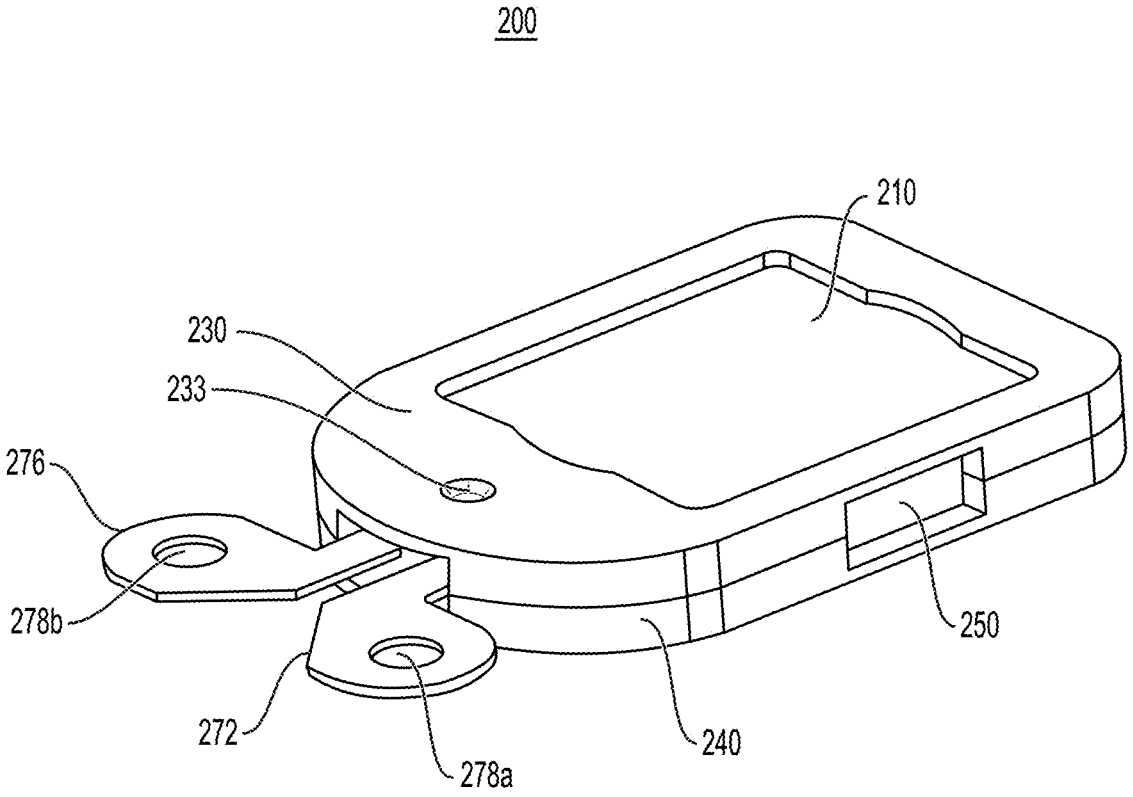
FIG. 7 is a perspective view of a first side of another capsule for an aerosol-generating device according to an example embodiment.
Figure 8:
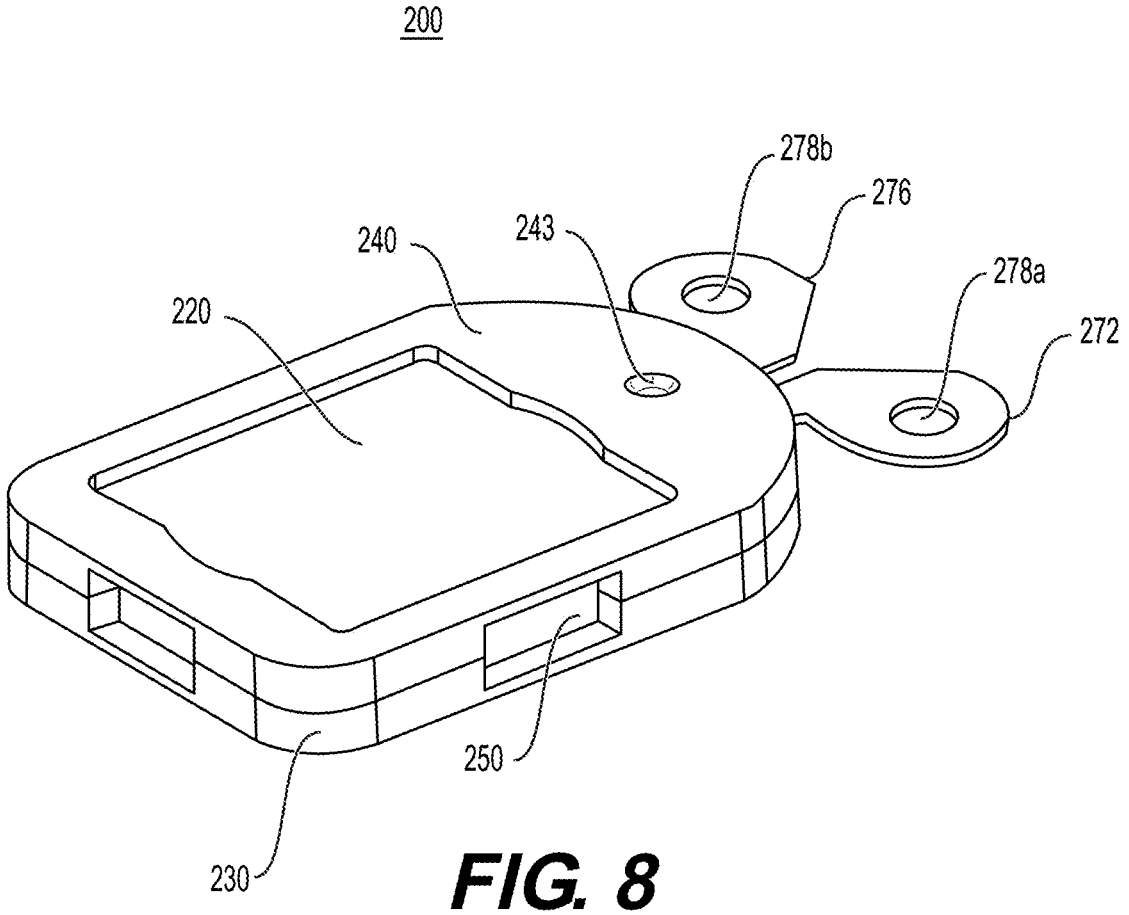
FIG. 8 is a perspective view of an opposing second side of the capsule of FIG. 7.

FIG. 7 is a perspective view of a first side of another capsule for an aerosol-generating device according to an example embodiment. FIG. 8 is a perspective view of an opposing second side of the capsule of FIG. 7. Referring to FIGS. 7-8, the capsule 200 may be configured to be received within an aerosol-generating device (e.g., heat-not-burn aerosol-generating device). The capsule 200 in FIGS. 7-8 may resemble the capsule 100 in FIGS. 1-2 while differing with regard to the form of the heater and the third frame, which will be discussed in more detail herein. As a result, the relevant disclosures above of the features in common should be understood to apply to this section and may not have been repeated in the interest of brevity. In the drawings, the capsule 200 has a laminar structure and a generally planar form. The proximal end of the capsule 200 may have a curved proximal edge, and the opposing distal end may have a linear distal edge. In addition, a pair of linear side edges may connect the curved proximal edge and the linear distal edge. The pair of linear side edges may be parallel to each other. Furthermore, the junctions of the linear side edges with the linear distal edge may be in the form of rounded corners.

Although the capsule 200 is shown in the figures as resembling a rectangle with a semicircular end (e.g., elongated semicircle, semi-obround), it should be understood that other configurations may be employed. For instance, the shape may be circular such that the capsule 200 has a disk-like appearance. In another instance, the shape of the capsule 200 may be elliptical or racetrack-like. In other instances, the capsule 200 may have a polygonal shape (regular or irregular), including a triangle, a rectangle (e.g., square), a pentagon, a hexagon, a heptagon, or an octagon. The laminar structure and generally planar form of the capsule 200 may facilitate stacking so as to allow a plurality of capsules to be stored in an aerosol-generating device or other receptacle for dispensing a new capsule or receiving a depleted capsule.

The capsule 200 may include a housing and a heater 270 (e.g., FIG. 11) within the housing. The housing of the capsule 200 has interior surfaces defining a chamber configured to hold an aerosol-forming substrate. In addition, the housing of the capsule 200 has exterior surfaces constituting a first face, an opposing second face, and a side face of the capsule 200. The first face and the second face of the capsule 200 may be permeable to an aerosol. The side face of the capsule 200 is between the first face and the second face. The side face may be regarded as a periphery of the capsule 200.

The housing of the capsule 200 includes a first frame 230 and a second frame 240. The first frame 230 and the second frame 240 may be of the same shape and size (e.g., based on a plan view) and aligned such that the outer sidewalls are substantially flush with each other, although example embodiments are not limited thereto. The first frame 230 and the second frame 240 may be formed of a suitable polymer, such as polyether ether ketone (PEEK), liquid crystal polymer (LCP), and/or ultra-high molecular weight polyethylene (UHMWPE). The first frame 230 and the second frame 240 may be connected via a welded arrangement.

A first permeable structure 210 is secured and exposed by the first frame 230. Similarly, a second permeable structure 220 is secured and exposed by the second frame 240. As will be discussed in more detail herein, a third frame 250 is disposed between the first permeable structure 210 and the second permeable structure 220 (as well as between the first frame 230 and the second frame 240). The capsule 200 is configured to hold an aerosol-forming substrate, which may be within the third frame 250 and between the first permeable structure 210 and the second permeable structure 220. The first concavity 233 (e.g., first dimpled portion) in the first frame 230 and the second concavity 243 (e.g., second dimpled portion) in the second frame 240 may be from an injection molding process. In this regard, the size, location, and/or shape of the first concavity 233 and the second concavity 243 may differ (or may be absent altogether) depending on the fabrication technique.

The first permeable structure 210 and the second permeable structure 220 may be in a form of a mesh sheet, a perforated sheet, or a combination thereof. For instance, both the first permeable structure 210 and the second permeable structure 220 may be in a form of a mesh sheet. In another instance, both the first permeable structure 210 and the second permeable structure 220 may be in a form of a perforated sheet (e.g., 80, 100, or 250 mesh equivalent). The perforated sheet may be one that is perforated mechanically or chemically (e.g., via photochemical machining/etching). In yet another instance, one of the first permeable structure 210 or the second permeable structure 220 may be in a form of a mesh sheet, while the other of the first permeable structure 210 or the second permeable structure 220 may be in a form of a perforated sheet. The first permeable structure 210 and the second permeable structure 220 (as well as the first frame 230 and the second frame 240) may be substantially the same size based on a plan view (e.g., ±10% of a given dimension).

As shown in FIG. 7, the combination of the exposed surface of the first permeable structure 210 and the adjacent (e.g., substantially coplanar/parallel) surface the first frame 230 may be regarded as the first face of the capsule 200. Similarly, as shown in FIG. 8, the combination of the exposed surface of the second permeable structure 220 and the adjacent (e.g., substantially coplanar/parallel) surface of the second frame 240 may be regarded as the second face of the capsule 200. In one instance, the first face, the second face, or both may include perforated sheets. In another instance, the first face, the second face, or both may include mesh sheets. In yet another instance, one of the first face or the second face may include a perforated sheet, while the other of the first face or the second face may include a mesh sheet.

As noted supra and as will be discussed herein in more detail, a heater 270 (e.g., FIG. 11) may be disposed within the capsule 200 to heat the aerosol-forming substrate. The heater 270 may include, inter alia, a first end section 272 and a second end section 276 configured to receive an electric current from a power source during an activation of the heater 270. When the heater 270 is activated, the temperature of the aerosol-forming substrate may increase, and an aerosol may be generated and released through the first permeable structure 210 and/or the second permeable structure 220 of the capsule 200.

As shown in FIGS. 7-8, the combination of the exposed surfaces of the third frame 250 and the adjacent sidewalls of the first frame 230 and the second frame 240 may be regarded as the side face of the capsule 200. The first end section 272 and the second end section 276 may be external segments of the heater 270 that protrude beyond the housing (e.g., and the side face) of the capsule 200 (e.g., to facilitate an electrical connection with a power source). The first end section 272 and the second end section 276 of the heater 270 may be coplanar, although example embodiments are not limited thereto. The first end section 272 and the second end section 276 of the heater 270 may also define apertures 278*a* and 278*b*, respectively. In another instance, the first end section 272 and the second end section 276 of the heater 270 may be configured similarly to the first end section 172 and the second end section 176 in FIG. 2 so as to constitute parts of the side face of the capsule 200. In such an instance, while the first end section 172 and the second end section 176 in FIG. 2 constitute parts of the side face at the distal end of the capsule 100, the first end section 272 and the second end section 276 in FIG. 7 may constitute parts of the side face at the proximal end of the capsule 200.

Figure 9:
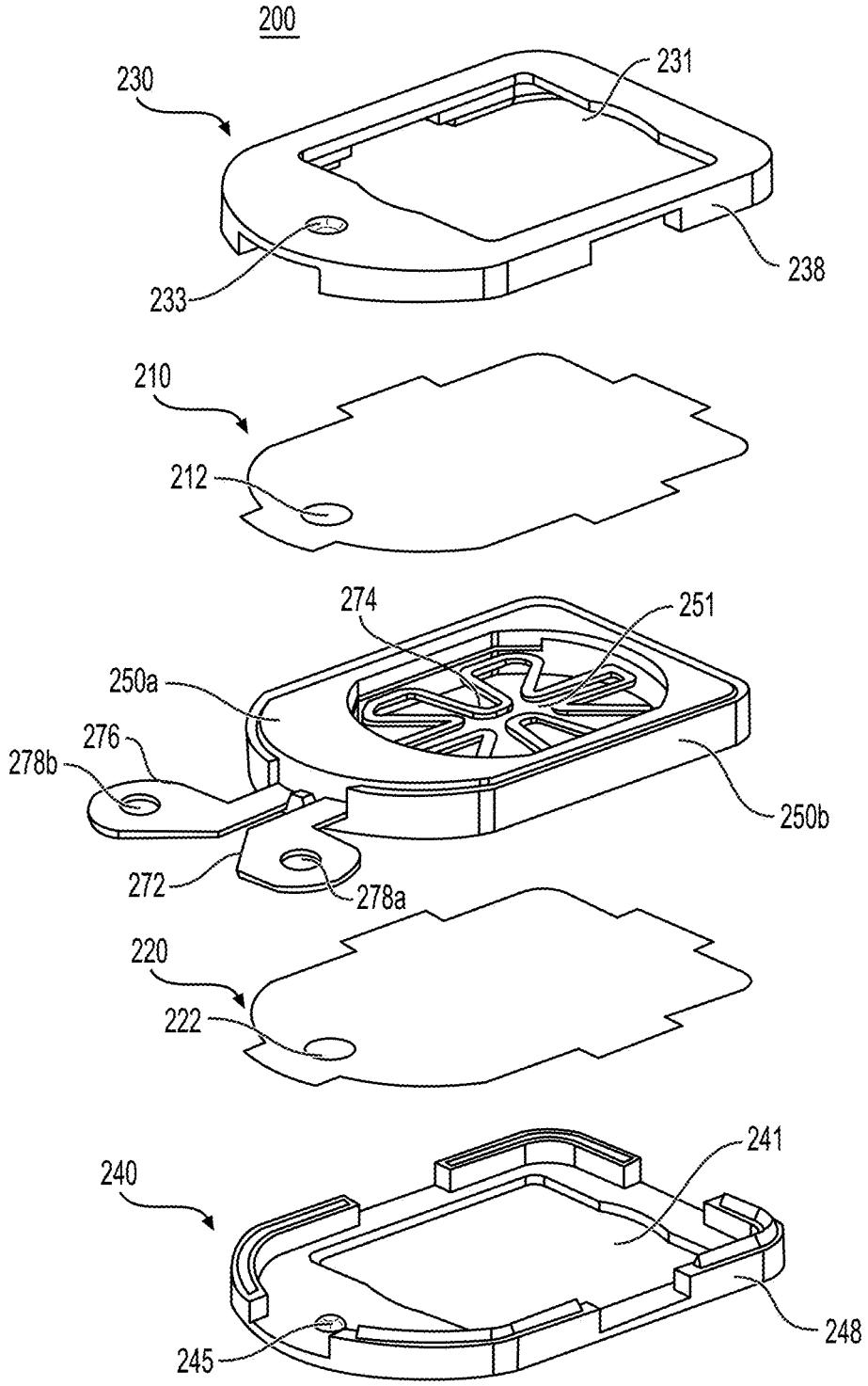
FIG. 9 is an exploded view of the capsule of FIG. 7.
Figure 10:
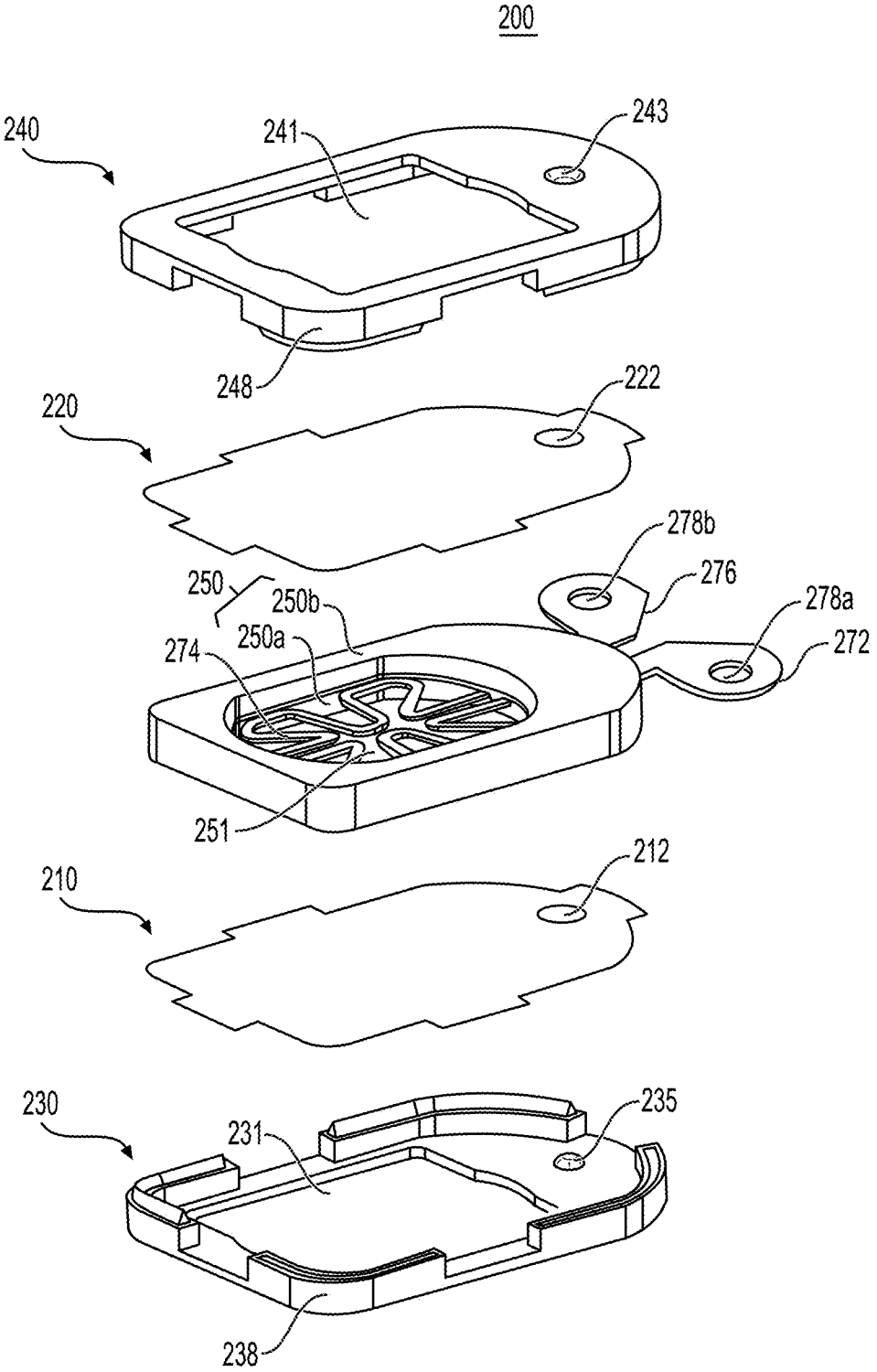
FIG. 10 is an exploded view of the capsule of FIG. 8.

FIG. 9 is an exploded view of the capsule of FIG. 7. FIG. 10 is an exploded view of the capsule of FIG. 8. Referring to FIGS. 9-10, the first frame 230 has a first interior face and a first exterior face. In addition, the first frame 230 defines a first opening 231. In an example embodiment, the sidewall of the first opening 231 has opposing linear sections and, optionally, opposing curved sections, wherein one curved section may be adjacent to the proximal end of the first frame 230, and the other curved section may be adjacent to the opposing distal end of the first frame 230. The first permeable structure 210 may be secured to the first interior face of the first frame 230 so as to be exposed by the first opening 231. From a different perspective, the first permeable structure 210 may also be regarded as covering the first opening 231. Furthermore, the first permeable structure 210 may define a first aperture 212. The first aperture 212 may be positioned and sized so as to accommodate the first convexity 235 when the first permeable structure 210 is secured to the first frame 230.

The second frame 240 has a second interior face and a second exterior face. In addition, the second frame 240 defines a second opening 241. In an example embodiment, the sidewall of the second opening 241 has opposing linear sections and, optionally, opposing curved sections, wherein one curved section may be adjacent to the proximal end of the second frame 240, and the other curved section may be adjacent to the opposing distal end of the second frame 240. The second permeable structure 220 may be secured to the second interior face of the second frame 240 so as to be exposed by the second opening 241. From a different perspective, the second permeable structure 220 may also be regarded as covering the second opening 241. The size and shape of the second opening 241 may correspond to (e.g., mirror) the size and shape of the first opening 231. Furthermore, the second permeable structure 220 may define a second aperture 222. The second aperture 222 may be positioned and sized so as to accommodate the second convexity 245 when the second permeable structure 220 is secured to the second frame 240.

The third frame 250 defines a cavity 251 configured to receive an aerosol-forming substrate. As will be discussed herein in more detail, the third frame 250 may be formed of components 250*a* and 250*b*. The combination of the sidewall of the cavity 251 and the interior surfaces of the first permeable structure 210 and the second permeable structure 220 (which cover the cavity 251) may be regarded as defining a chamber. In an example embodiment, the sidewall of the cavity 251 has opposing linear sections and opposing curved sections, wherein one curved section is adjacent to the proximal end of the third frame 250, and the other curved section is adjacent to the opposing distal end of the third frame 250. The third frame 250 may be substantially the same size as the first permeable structure 210 and the second permeable structure 220 based on a plan view (e.g., ±10% of a given dimension). In addition to the materials of construction for the first frame 230 and the second frame 240, the third frame 250 may also be formed of other suitable materials, such as ceramic, sintered glass, and/or consolidated fibers (e.g., cardboard).

A heater 270 is configured to extend through the third frame 250 and into the cavity 251. Additionally, the heater 270 may be regarded as being supported by the third frame 250. The heater 270 includes a first end section 272, an intermediate section 274, and a second end section 276. The first end section 272 and the second end section 276 of the heater 270 are external segments disposed outside the capsule 200. The first end section 272 and the second end section 276 of the heater 270 may also define apertures 278*a* and 278*b*, respectively, although example embodiments are not limited thereto. The intermediate section 274 of the heater 270 is an internal segment disposed within the capsule 200 (e.g., within the chamber of the housing containing the aerosol-forming substrate). The first end section 272, the intermediate section 274, and the second end section 276 of the heater 270 are sections of a continuous structure. In an example embodiment, the intermediate section 274 of the heater 270 has a planar and winding form.

The first permeable structure 210 and the second permeable structure 220 may be secured to the first frame 230 and the second frame 240, respectively, via a variety of attachment techniques. For instance, the attachment technique may involve injection molding (e.g., insert molding, over molding). In another instance, the attachment technique may involve ultrasonic welding. In other instances, the attachment technique may involve an adhesive (e.g., tape, glue) that has been deemed food-safe or otherwise acceptable by a regulatory authority. Alternatively, in lieu of a separate attachment technique, the first permeable structure 210 and the second permeable structure 220 may be clamped against the third frame 250 (or otherwise constrained) by the first frame 230 and the second frame 240, respectively.

The first frame 230 includes at least one first connector protruding from the first interior face of the first frame 230. The at least one first connector of the first frame 230 may be in a form of a first connector 238. In an example embodiment, the first connector 238 may extend along an edge of the first interior face of the first frame 230 in a form a ridge (e.g., first ridge). The ridge may define a trench extending along its entire length so as to resemble an elevated trench or a recessed/furrowed ridge. In addition or in the alternative, the ridge may have a tapered ridgeline and, as a result, may be referred to as a tapered ridge. Although the first connector 238 is shown as being separated into a plurality of discrete structures (e.g., four discrete structures), it should be understood that example embodiments are not limited thereto. For instance, alternatively, the first connector 238 may be a single, continuous structure extending along the edge so as to completely surround the first interior face of the first frame 230.

Similarly, the second frame 240 includes at least one second connector protruding from the second interior face of the second frame 240. The at least one second connector of the second frame 240 may be in a form of a second connector 248. The second connector 248 of the second frame 240 and the first connector 238 of the first frame 230 are complementary structures configured to mate with each other. In an example embodiment, the second connector 248 may extend along an edge of the second interior face of the second frame 240 in a form a ridge (e.g., second ridge). The ridge may define a trench extending along its entire length so as to resemble an elevated trench or a recessed/furrowed ridge. In addition or in the alternative, the ridge may have a tapered ridgeline and, as a result, may be referred to as a tapered ridge. Although the second connector 248 is shown as being separated into a plurality of discrete structures (e.g., four discrete structures), it should be understood that example embodiments are not limited thereto. For instance, alternatively, the second connector 248 may be a single, continuous structure extending along the periphery so as to completely surround the second interior face of the second frame 240.

In the non-limiting embodiment illustrated in FIGS. 9-10 where the first connector 238 of the first frame 230 is separated into four discrete structures, two of the structures may be elevated trenches, while the other two structures may be tapered ridges. Conversely, the second connector 248 of the second frame 240 may be separated into four discrete structures, wherein two of the structures are tapered ridges, while the other two structures are elevated trenches. The mixed set of elevated trenches and tapered ridges of the first frame 230 are configured to mate with the mixed set of tapered ridges and elevated trenches, respectively, of the second frame 240 during the assembly of the capsule 200. It should be understood that various combinations of elevated trenches and the tapered ridges are possible for the first frame 230 and the second frame 240. Furthermore, each of the first permeable structure 210 and the second permeable structure 220 may have tab-like extensions (e.g., four tab-like extensions) disposed between the discrete structures of the first connector 238 and the second connector 248, respectively, when the capsule 200 is assembled.

A tapered ridge of the first connector 238 and/or the second connector 248 may have a shoulder portion and an inclined portion that rises from the shoulder portion to form a tapered ridgeline. The tapered ridgeline may function as an energy director during assembly (e.g., to facilitate welding). A corresponding elevated trench of the first connector 238 and/or the second connector 248 may have a rim portion and a trench bottom. As shown in FIG. 9-10, the trench bottom of the elevated trench may be a planar bottom. Alternatively, the trench bottom of the elevated trench may be a V-shaped bottom. In an example embodiment of a connection between the first frame 230 and the second frame 240, the inclined portion of a tapered ridge is configured to contact the trench bottom of a corresponding elevated trench, while the shoulder portion of the tapered ridge interfaces with the rim portion of the elevated trench. Thus, the engagement surfaces of the first connector 238 and the second connector 248 may be inversely or complementarily configured to facilitate mating.

When the mixed set of elevated trenches and tapered ridges of each frame are grouped such that the elevated trenches are on one linear side edge while the tapered ridges are on the other linear side edge, as shown in FIGS. 9-10, the first frame 230 and the second frame 240 may be identical parts. In such an instance, orienting the first frame 230 and the second frame 240 to face each other for mating will result in a complementary arrangement. As a result, one part may be used interchangeably as the first frame 230 or the second frame 240, thus simplifying the method of manufacturing.

To assemble the capsule 200, the first frame 230 may be connected to the second frame 240 after an aerosol-forming substrate is disposed within the cavity 251 of the third frame 250 (e.g., so as to be on both sides of the intermediate section 274 of the heater 270). In such an instance, the third frame 250 will be sandwiched between the first permeable structure 210 and the second permeable structure 220 when the first frame 230 is connected to the second frame 240. During assembly, the at least one first connector of the first frame 230 is configured to engage with the at least one second connector of the second frame 240 to form at least one connection (e.g., four connections). For instance, an elevated trench (and/or tapered ridge) of the first connector 238 is configured to mate with a corresponding tapered ridge (and/or elevated trench) of the second connector 248. In addition, the joinder between the first connector 238 of the first frame 230 and the second connector 248 of the second frame 240 may be achieved via a welded arrangement (e.g., ultrasonic welding). Furthermore, the outer sidewall of the first frame 230 may be substantially flush with the outer sidewall of the second frame 240 when the capsule 200 is assembled, although example embodiments are not limited thereto. Once assembled, the capsule 200 is difficult or impracticable to open without damaging the connectors, the frames, and/or other aspects of the capsule 200. As a result, the capsule 200 is relatively tamper-proof against unauthorized actions by third parties.

The capsule 200 has been described as including, inter alia, a first frame 230 that is separate from a second frame 240. Alternatively, in some instances, the first frame 230 and the second frame 240 may be fabricated as a single structure that is configured to fold during assembly such that the first connector 238 engages with the second connector 248. For example, the first frame 230 and the second frame 240 may resemble a clamshell structure, wherein the linear distal edge of the first frame 230 is connected to the linear distal edge of the second frame 240 with an integral section of reduced thickness that functions as a fold line. In another example, a linear side edge of the first frame 230 may be connected to a linear side edge of the second frame 240 with an integral section of reduced thickness that functions as a fold line. With a clamshell structure, it should be understood that one or more connections (e.g., along the fold line) may be omitted from the capsule 200.

Figure 11:
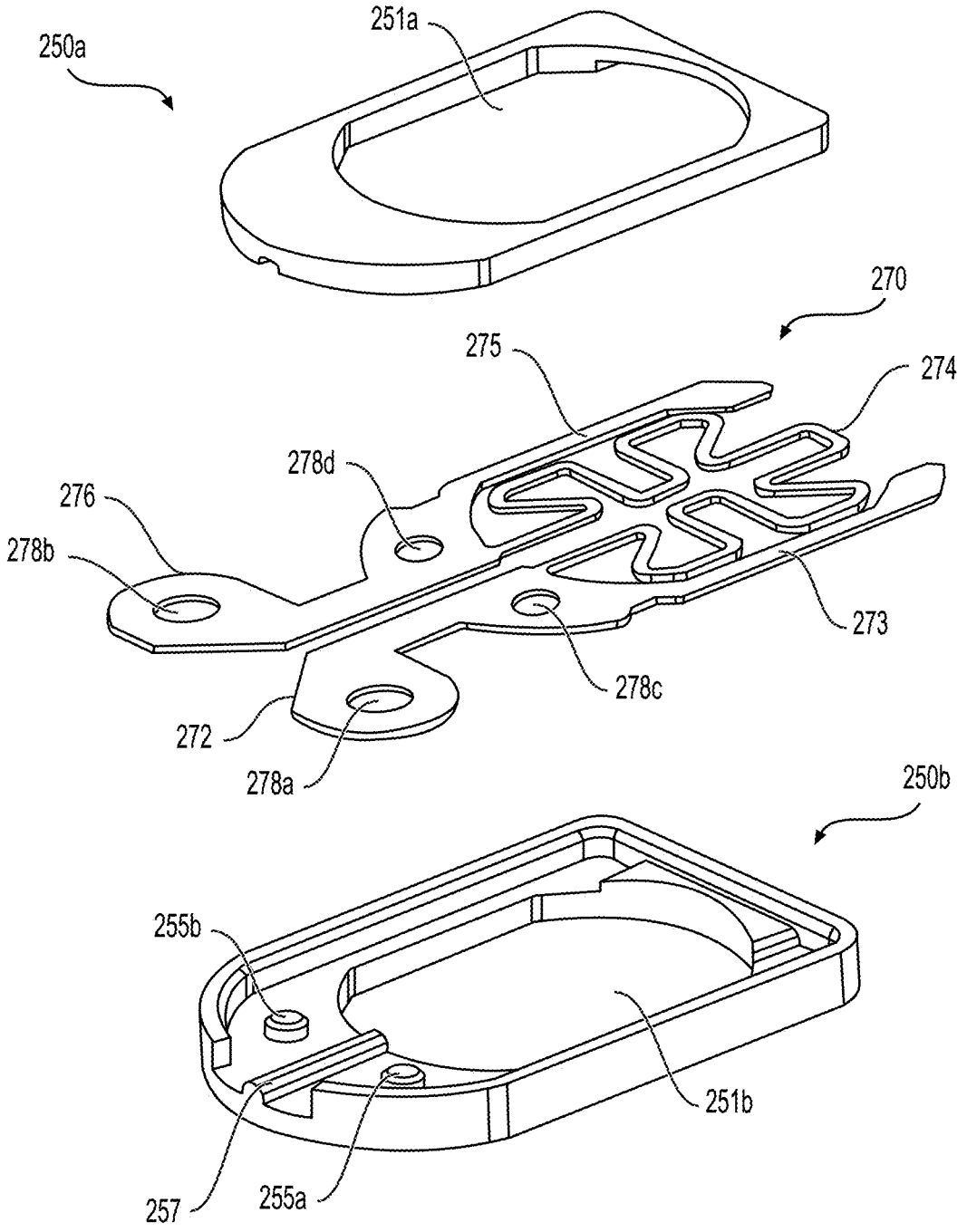
FIG. 11 is an isolated view of the heater and the third frame in FIG. 9.
Figure 12:
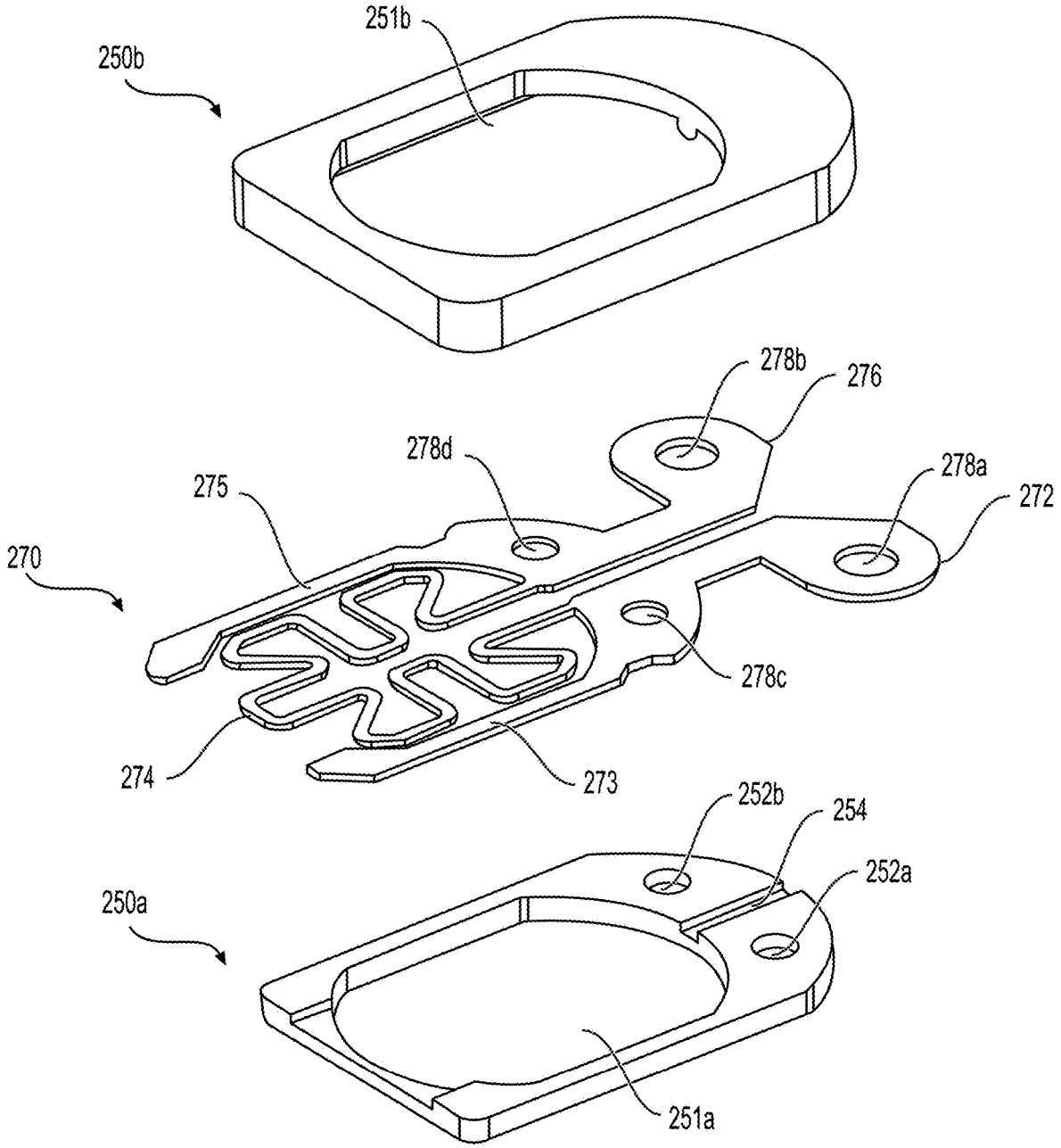
FIG. 12 is an isolated view of the heater and the third frame in FIG. 10.

FIG. 11 is an isolated view of the heater and the third frame in FIG. 9. FIG. 12 is an isolated view of the heater and the third frame in FIG. 10. Referring to FIGS. 11-12, the heater 270 includes a first end section 272, a first arm portion 273, an intermediate section 274, a second arm portion 275, and a second end section 276. As noted supra, the first end section 272 and the second end section 276 of the heater 270 may define apertures 278*a* and 278*b*, respectively. Additionally, the first arm portion 273 and the second arm portion 275 may define apertures 278*c* and 278*d*, respectively, although example embodiments are not limited thereto. In one instance, the heater 270 may have a planar form. As a result, the first end section 272, the first arm portion 273, the intermediate section 274, the second arm portion 275, and the second end section 276 may be coplanar. Alternatively, the heater 270 may have a configuration wherein the first end section 272 and the second end section 276 resemble the first end section 172 and the second end section 176 of the heater 170 (e.g., folded configuration shown in FIGS. 5-6). Furthermore, the heater 270 may be symmetrical about its longitudinal axis. The longitudinal axis of the heater 270 may be within the plane corresponding to the heater 270 so as to bisect the intermediate section 274 and extend (e.g., equidistantly) between the first end section 272 and the second end section 276.

In an example embodiment, the heater 270 is configured to undergo Joule heating (which is also known as ohmic/resistive heating) upon the application of an electric current thereto. Stated in more detail, the heater 270 may be formed of one or more conductors and configured to produce heat when an electric current passes therethrough. The electric current may be supplied to the first end section 272 and the second end section 276 of the heater 270 from a power source (e.g., battery) within the aerosol-generating device. Suitable conductors for the heater 270 include an iron-based alloy (e.g., stainless steel, iron aluminides), a nickel-based alloy (e.g., nichrome), and/or a ceramic (e.g., ceramic coated with metal). The intermediate section 274 of the heater 270 may have a thickness of about 0.1-0.3 mm (e.g., 0.15-0.25 mm) and a resistance of about 0.5-2.5 Ohms (e.g., 1-2 Ohms).

The electric current from the power source within the aerosol-generating device may be transmitted via electrodes configured to electrically contact the first end section 272 and the second end section 276 of the heater 270 when the capsule 200 is inserted into the aerosol-generating device. In a non-limiting embodiment, the electrodes within the aerosol-generating device may be spring-loaded to enhance an engagement with the heater 270 of the capsule 100. For instance, a spring-loaded first electrode within the aerosol-generating device may have a rounded or beveled engagement portion configured to electrically contact the first end section 272 of the heater 270 such that the engagement portion is seated within the aperture 278*a* in the first end section 272. Similarly, a spring-loaded second electrode within the aerosol-generating device may have a rounded or beveled engagement portion configured to electrically contact the second end section 276 of the heater 270 such that the engagement portion is seated within the aperture 278*b* in the second end section 276. In such instances, the engagement of the first electrode and the second electrode of the aerosol-generating device with the first end section 272 and the second end section 276, respectively, of the heater 270 may produce a confirmatory click. The spring-loading of the electrodes may be in a direction that is orthogonal to the plane of the heater 270. In addition to or in lieu of the spring-loading, the movement (e.g., engagement, release) of the electrodes may be achieved by mechanical actuation. Furthermore, the supply of the electric current from the aerosol-generating device to the capsule 200 may be a manual operation (e.g., button-activated) or an automatic operation (e.g., puff-activated).

The third frame 250 may be structured as or composed of components 250*a* and 250*b* which are configured to engage and clamp the heater 270 therebetween. For instance, the components 250*a* and 250*b* may define corresponding openings 251*a* and 251*b*, respectively, that form the cavity 251 of the third frame 250. In such an instance, when assembled, the intermediate section 274 of the heater 270 is within the cavity 251 of the third frame 250, while the first arm portion 273 and the second arm portion 275 of the heater 270 are within at least the proximal and side portions of the third frame 250, and the first end section 272 and the second end section 276 of the heater 270 are outside the cavity 251 and extend beyond the proximal end of the third frame 250.

In an example embodiment, component 250*b* may include a ridged portion 257, and component 250*a* may define a corresponding grooved portion 254 (or vice versa) configured to receive the ridged portion 257 when the components 250*a* and 250*b* are engaged. In such an embodiment, the ridged portion 257 may be between and insulate the first end section 272 and the second end section 276 of the heater 270 from each other when the heater 270 is clamped by the components 250*a* and 250*b* of the third frame 250. Additionally, component 250*b* may include projections 255*a* and 255*b*, and component 250*a* may define corresponding apertures 252*a* and 252*b* (or vice versa) configured to receive the projections 255*a* and 255*b*, respectively, when the components 250*a* and 250*b* are engaged. Furthermore, the projections 255*a* and 255*b* of component 250*b* may extend through the first arm portion 273 and the second arm portion 275 of the heater 270 via apertures 278*c* and 278*d*, respectively.

Component 250*a* is configured to be received by component 250*b* to form the third frame 250. In an example embodiment, component 250*a* is dimensioned to seat within a corresponding recess in component 250*b*. In such an embodiment, the outer sidewall of component 250*a* may engage with the inner sidewall of component 250*b*. Such an engagement may be via an interference fit (which may also be referred to as a press fit or friction fit). Also, the thickness of component 250*a* and/or the depth of the corresponding recess in component 250*b* may be dimensioned such that, when the heater 270 is clamped between component 250*a* and component 250*b*, the exterior surface of component 250*a* is substantially flush with the rim of component 250*b*. While the third frame 250 is disclosed as being composed of components 250*a* and 250*b*, it should be understood that, in other instances, the third frame 250 may be a monolithic structure. In such instances, the heater 270 may be embedded within the third frame 250 via injection molding.

The intermediate section 274 of the heater 270 may be in the form of a pattern that spans a majority of the open area in the cavity 251. For instance, the pattern may be such that the intermediate section 274 of the heater 270 meanders or undulates around the center of the cavity 251 of the third frame 250. In such an instance, the intermediate section 274 of the heater 270 may alternate between extending toward the center of the cavity 251 and away from the center of the cavity 251. As illustrated in FIGS. 11-12, the undulations of the intermediate section 274 of the heater 270 may be in the form of five protuberances (e.g., lobes, wings, fingers) that do not contact the sidewall of the cavity 251 of the third frame 250, although example embodiments are not limited thereto.

Figure 13:
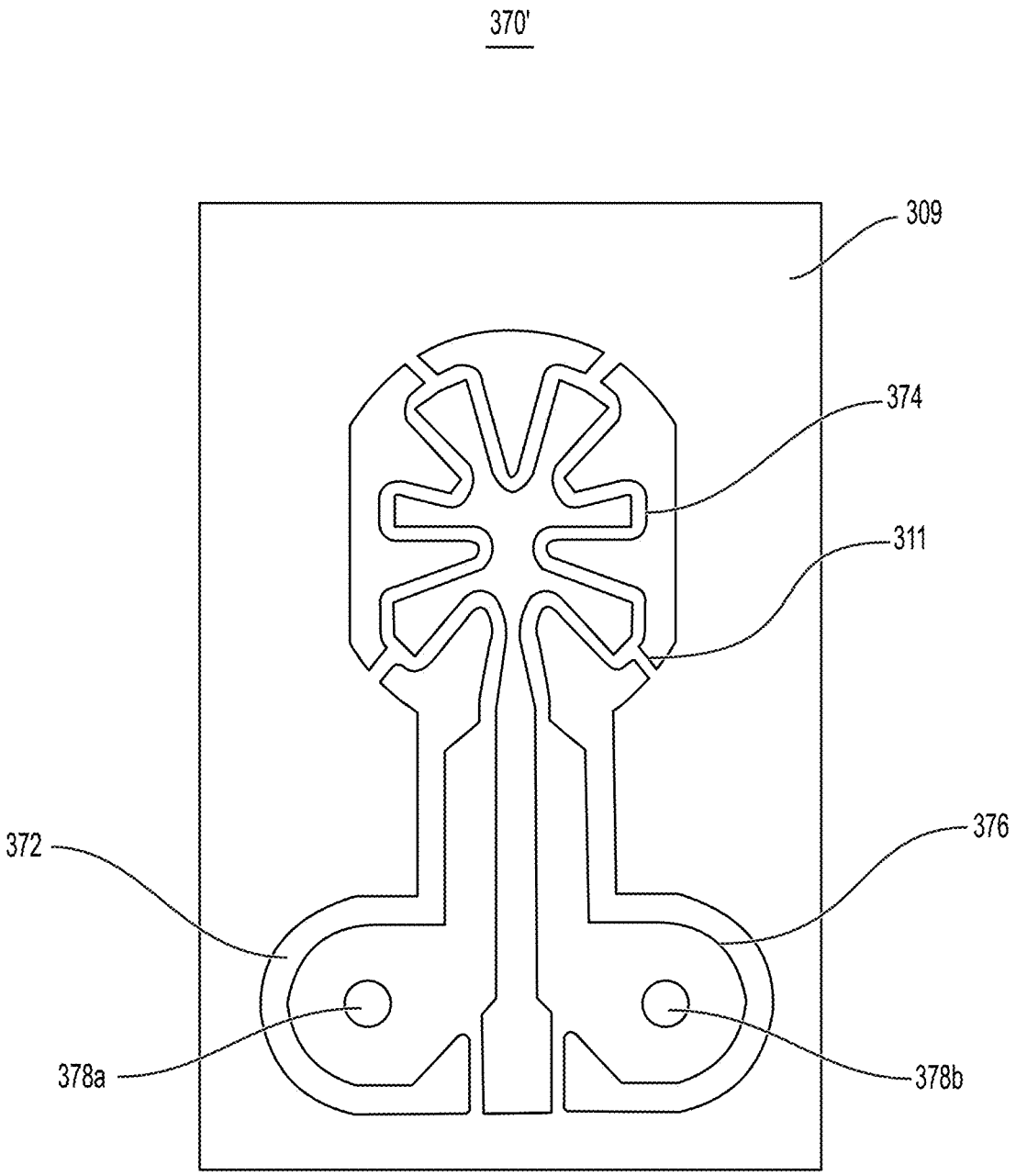
FIG. 13 is a plan view of a patterned sheet in connection with the fabrication of a heater according to an example embodiment.

FIG. 13 is a plan view of a patterned sheet in connection with the fabrication of a heater according to an example embodiment. Referring to FIG. 13, a sheet material may be cut or otherwise processed (e.g., stamping, electrochemical etching, die cutting, laser cutting) to produce a patterned sheet 370'. The sheet material is formed of one or more conductors configured to undergo Joule heating (which is also known as ohmic/resistive heating). Suitable conductors for the sheet material include an iron-based alloy (e.g., stainless steel, iron aluminides), a nickel-based alloy (e.g., nichrome), and/or a ceramic (e.g., ceramic coated with metal). For instance, the stainless steel may be a type known in the art as SS316L, although example embodiments are not limited thereto. The sheet material may have a thickness of about 0.1-0.3 mm (e.g., 0.15-0.25 mm).

The patterned sheet 370' includes a heater having a first end section 372, an intermediate section 374, and a second end section 376. The first end section 372 and the second end section 376 may define apertures 378*a* and 378*b*, respectively. A sheet portion 309 is connected to the first end section 372, the intermediate section 374, and the second end section 376 via breakout portions 311. During a subsequent step of the fabrication process, the breakout portions 311 are cut to allow the first end section 372, the intermediate section 374, and the second end section 376 of the heater 370 (FIG. 14) to be separated from the sheet portion 309. Although six breakout portions 311 are illustrated, it should be understood that example embodiments are not limited thereto.

Figure 14:
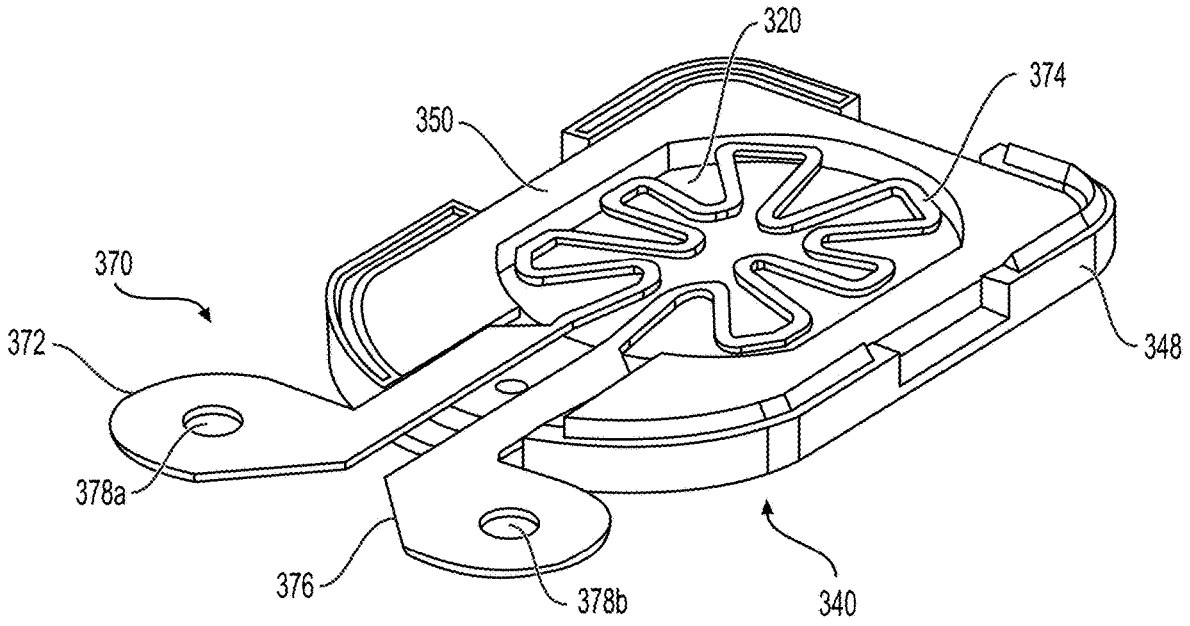
FIG. 14 is a perspective view of a partially-assembled capsule including a heater obtained from the patterned sheet of FIG. 13.

FIG. 14 is a perspective view of a partially-assembled capsule including a heater obtained from the patterned sheet of FIG. 13. The partially-assembled capsule in FIG. 14 may resemble corresponding aspects of the capsule 200 in FIGS. 7-12. For instance, the second permeable structure 320, the second frame 340, and the second connector 348 in FIG. 14 may be as described in connection with the second permeable structure 220, the second frame 240, and the second connector 248, respectively, in FIG. 9. As a result, the relevant disclosures above of the features in common should be understood to apply to this section and may not have been repeated in the interest of brevity.

In an example embodiment, the proximal portion of the third frame 350 defines a recess or channel configured to accommodate the heater 370. Each of the segments of the heater 370 seated in the channel in the third frame 350 may be wider than the segment of the heater 370 (e.g., intermediate section 374) within the cavity of the third frame 350. Each of these wider segments of the heater 370 will have a lower resistance than a narrower segment of the heater 370 and, thus, may function as a thermal relief segment.

The intermediate section 374 of the heater 370 may be in the form of a pattern that spans a majority of the open area in the cavity of the third frame 350. For instance, the pattern may be such that the intermediate section 374 of the heater 370 meanders or undulates around the center of the cavity of the third frame 350. In such an instance, the intermediate section 374 of the heater 370 may alternate between extending toward the center of the cavity and away from the center of the cavity. As illustrated in FIG. 14, the undulations of the intermediate section 374 of the heater 370 may be in the form of six protuberances (e.g., lobes, wings, fingers) that do not contact the sidewall of the cavity of the third frame 350, although example embodiments are not limited thereto.

Although not illustrated in FIG. 14, it should be understood that a first frame and a first permeable structure (as discussed herein) along with an inner frame (which complements the third frame 350) may be provided to enclose an aerosol-forming substrate so as to complete the assembly of the capsule. The complementary inner frame may mimic the third frame 350 while omitting the channel for the heater 370. In such an instance, the complementary inner frame may have interior and exterior surfaces that are completely planar. Alternatively, the complementary inner frame may include a ridged portion configured to seat between the wider segments of the heater 370 in the channel of the third frame 350 when the capsule is assembled.

Figure 15:
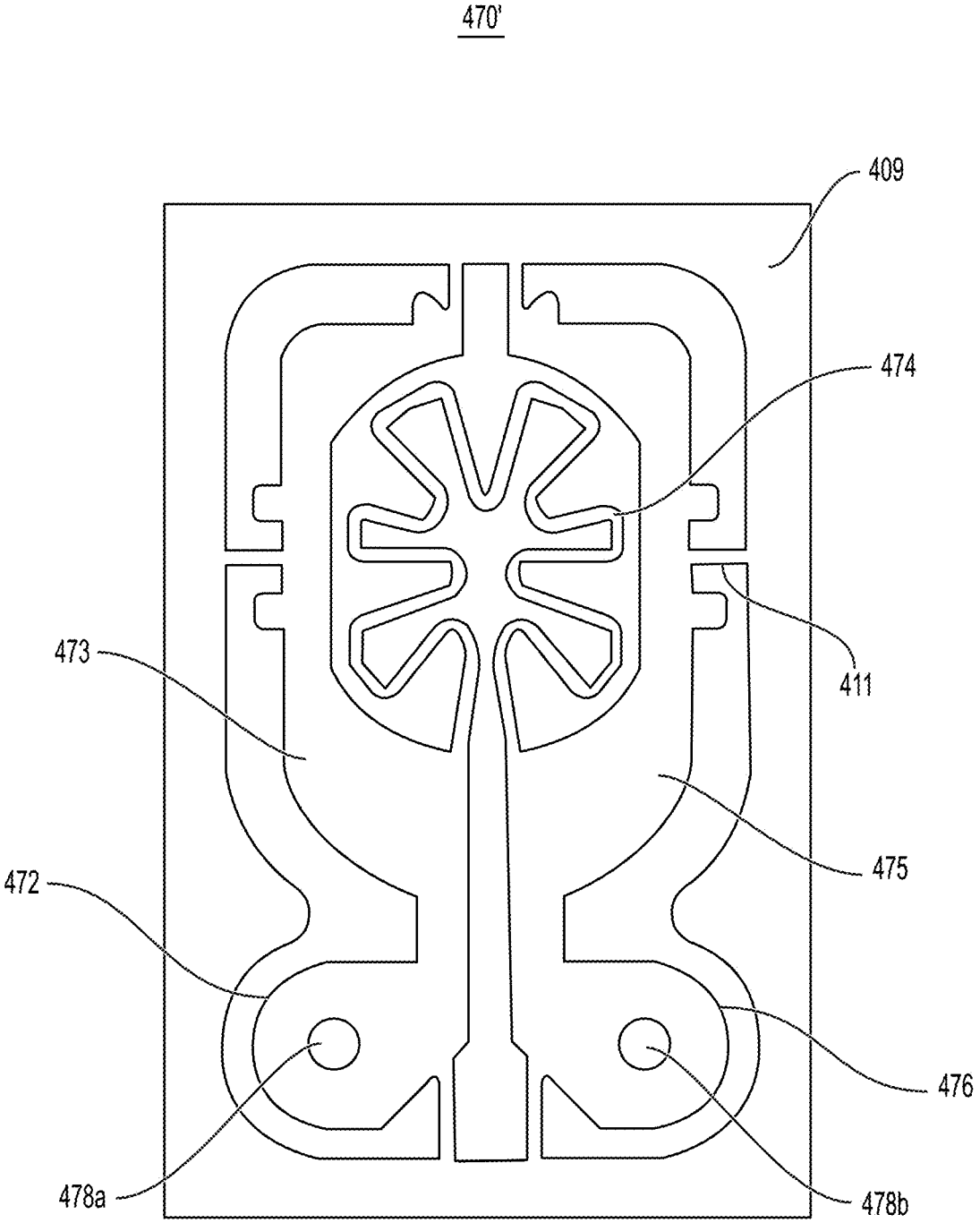
FIG. 15 is a plan view of another patterned sheet in connection with the fabrication of a heater according to an example embodiment.

FIG. 15 is a plan view of another patterned sheet in connection with the fabrication of a heater according to an example embodiment. Referring to FIG. 15, a sheet material may be cut or otherwise processed (e.g., stamping, electrochemical etching, die cutting, laser cutting) to produce a patterned sheet 470'. The patterned sheet 470' may be as described in connection with the patterned sheet 370' in FIG. 13 except for the presence of arm portions. As a result, the relevant disclosures above of the features in common should be understood to apply to this section and may not have been repeated in the interest of brevity. As shown, the patterned sheet 470' includes a heater having a first end section 472, a first arm portion 473, an intermediate section 474, a second arm portion 475, and a second end section 476. The first end section 472 and the second end section 476 may define apertures 478*a* and 478*b*, respectively. The first arm portion 473 and the second arm portion 475 may function as support structures as well as thermal relief segments. A sheet portion 409 is connected to the first end section 472, the first arm portion 473, the second arm portion 475, and the second end section 476 via breakout portions 411. During a subsequent step of the fabrication process, the breakout portions 411 are cut to allow the first end section 472, the first arm portion 473, the second arm portion 475, and the second end section 476 of the heater to be separated from the sheet portion 409. Although six breakout portions 411 are illustrated, it should be understood that example embodiments are not limited thereto. Furthermore, the first arm portion 473 and the second arm portion 475 may include alignment tabs (e.g., six alignment tabs) adjacent to the breakout portions 411 to facilitate a placement of the heater during the assembly of the capsule.

Figure 16:
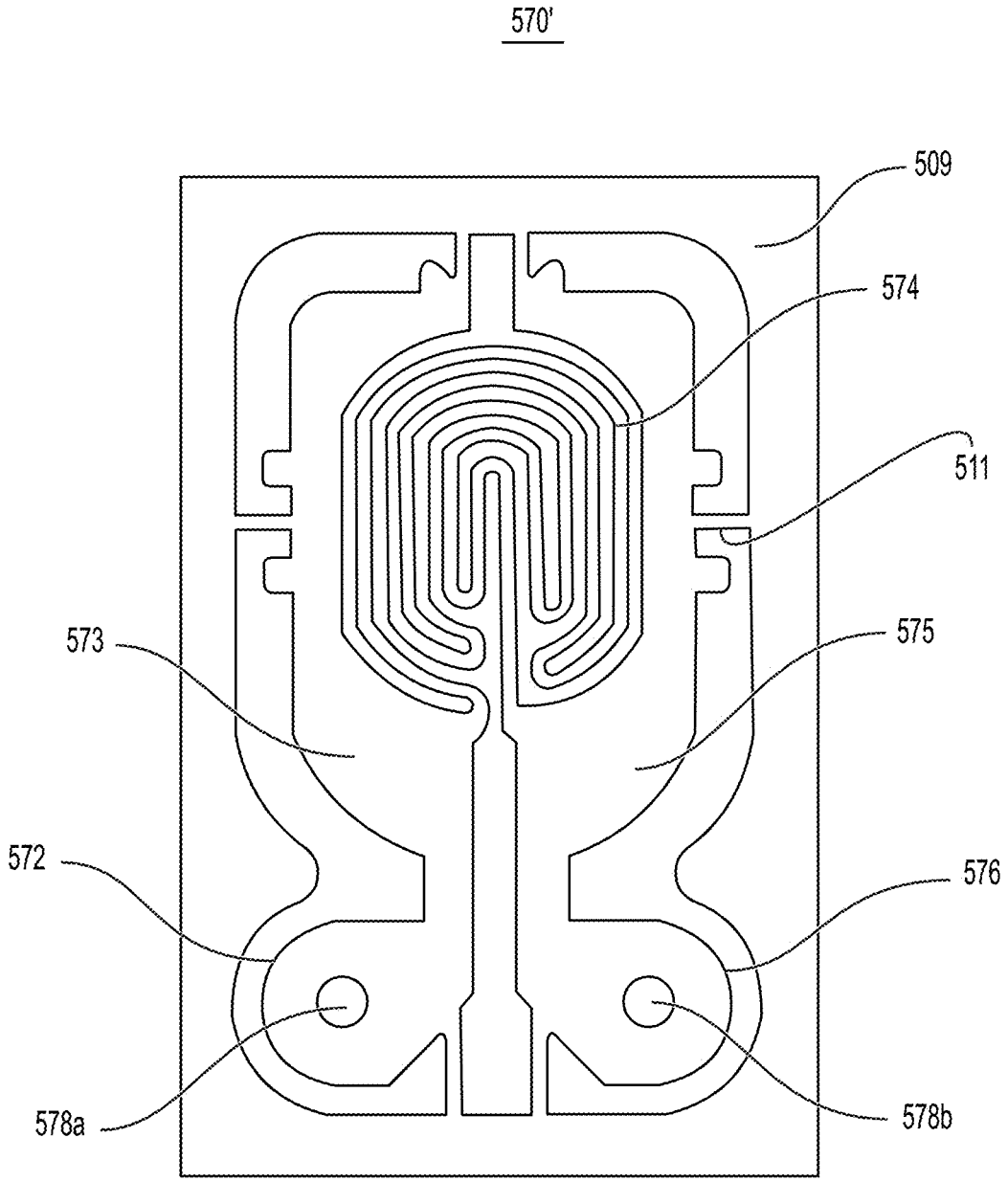
FIG. 16 is a plan view of another patterned sheet in connection with the fabrication of a heater according to an example embodiment.

FIG. 16 is a plan view of another patterned sheet in connection with the fabrication of a heater according to an example embodiment. Referring to FIG. 16, a sheet material may be cut or otherwise processed (e.g., stamping, electrochemical etching, die cutting, laser cutting) to produce a patterned sheet 570'. The patterned sheet 570' may be as described in connection with the patterned sheet 470' in FIG. 15 except for the form of the intermediate section of the heater. As a result, the relevant disclosures above of the features in common should be understood to apply to this section and may not have been repeated in the interest of brevity. As shown, the patterned sheet 570' includes a heater having a first end section 572, a first arm portion 573, an intermediate section 574, a second arm portion 575, and a second end section 576. The first end section 572 and the second end section 576 may define apertures 578*a* and 578*b*, respectively. The first arm portion 573 and the second arm portion 575 may function as support structures as well as thermal relief segments. The intermediate section 574 may have a winding form including loops, whorls, and/or arches and resembling a labyrinth or a fingerprint. A sheet portion 509 is connected to the first end section 572, the first arm portion 573, the second arm portion 575, and the second end section 576 via breakout portions 511. During a subsequent step of the fabrication process, the breakout portions 511 are cut to allow the first end section 572, the first arm portion 573, the second arm portion 575, and the second end section 576 of the heater to be separated from the sheet portion 509. Although six breakout portions 511 are illustrated, it should be understood that example embodiments are not limited thereto. Furthermore, the first arm portion 573 and the second arm portion 575 may include alignment tabs (e.g., six alignment tabs) adjacent to the breakout portions 511 to facilitate a placement of the heater during the assembly of the capsule.

Figure 17:
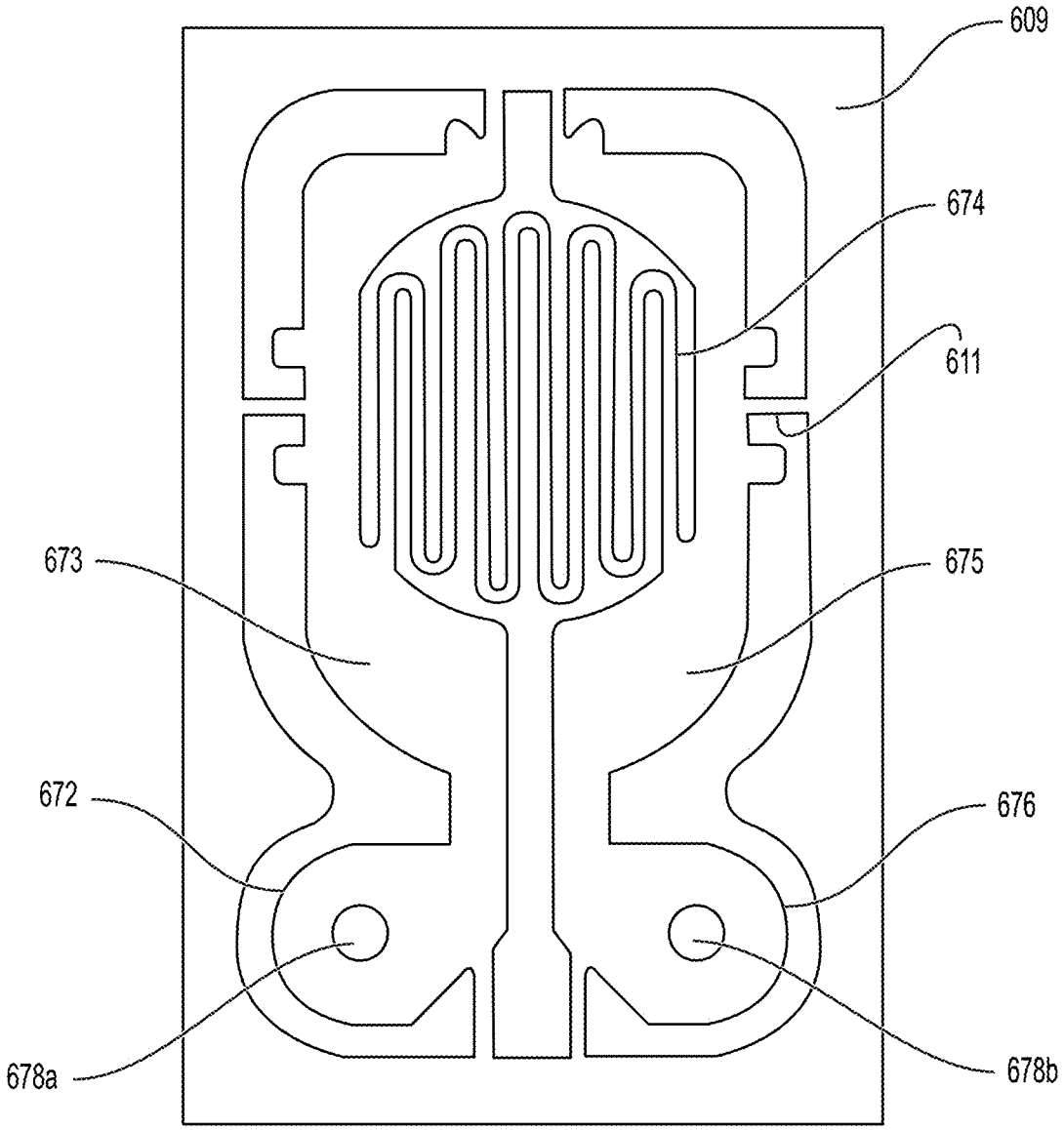
FIG. 17 is a plan view of another patterned sheet in connection with the fabrication of a heater according to an example embodiment.

FIG. 17 is a plan view of another patterned sheet in connection with the fabrication of a heater according to an example embodiment. Referring to FIG. 17, a sheet material may be cut or otherwise processed (e.g., stamping, electrochemical etching, die cutting, laser cutting) to produce a patterned sheet 670'. The patterned sheet 670' may be as described in connection with the patterned sheet 470' in FIG. 15 except for the form of the intermediate section of the heater. As a result, the relevant disclosures above of the features in common should be understood to apply to this section and may not have been repeated in the interest of brevity. As shown, the patterned sheet 670' includes a heater having a first end section 672, a first arm portion 673, an intermediate section 674, a second arm portion 675, and a second end section 676. The first end section 672 and the second end section 676 may define apertures 678*a* and 678*b*, respectively. The first arm portion 673 and the second arm portion 675 may function as support structures as well as thermal relief segments. The intermediate section 674 may have a winding form resembling a compressed oscillation or zigzag with a plurality of parallel segments (e.g., eight to twelve parallel segments). A sheet portion 609 is connected to the first end section 672, the first arm portion 673, the second arm portion 675, and the second end section 676 via breakout portions 611. During a subsequent step of the fabrication process, the breakout portions 611 are cut to allow the first end section 672, the first arm portion 673, the second arm portion 675, and the second end section 676 of the heater to be separated from the sheet portion 609. Although six breakout portions 611 are illustrated, it should be understood that example embodiments are not limited thereto. Furthermore, the first arm portion 673 and the second arm portion 675 may include alignment tabs (e.g., six alignment tabs) adjacent to the breakout portions 611 to facilitate a placement of the heater during the assembly of the capsule.

Figure 18:
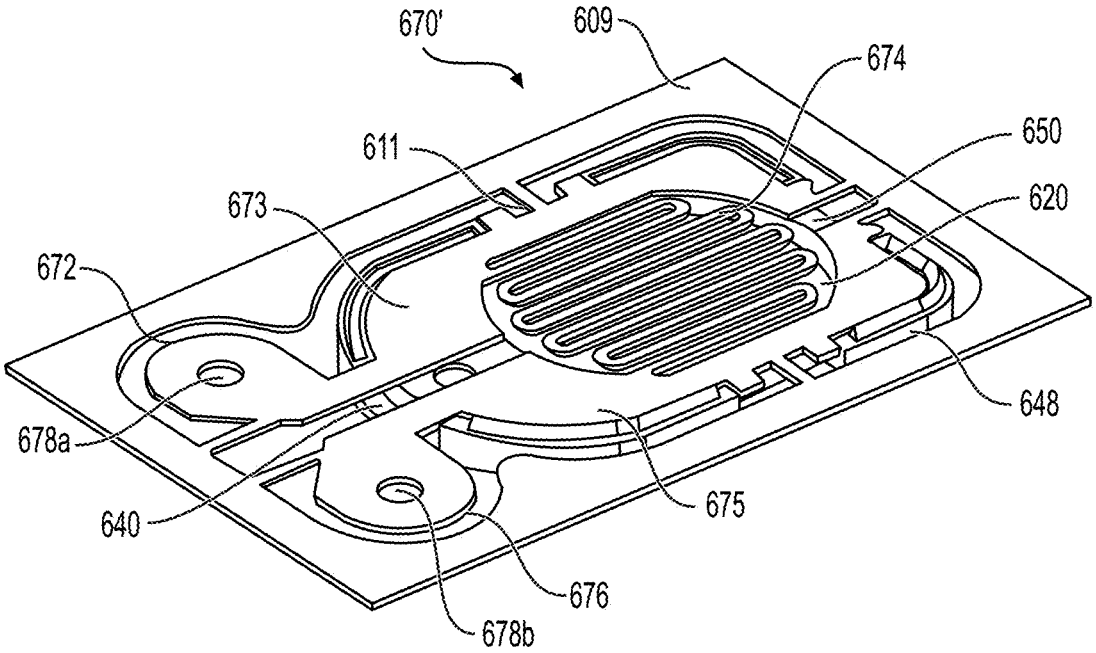
FIGS. 18-20 are perspective views of a method of manufacturing a capsule for an aerosol-generating device according to an example embodiment.
Figure 19:
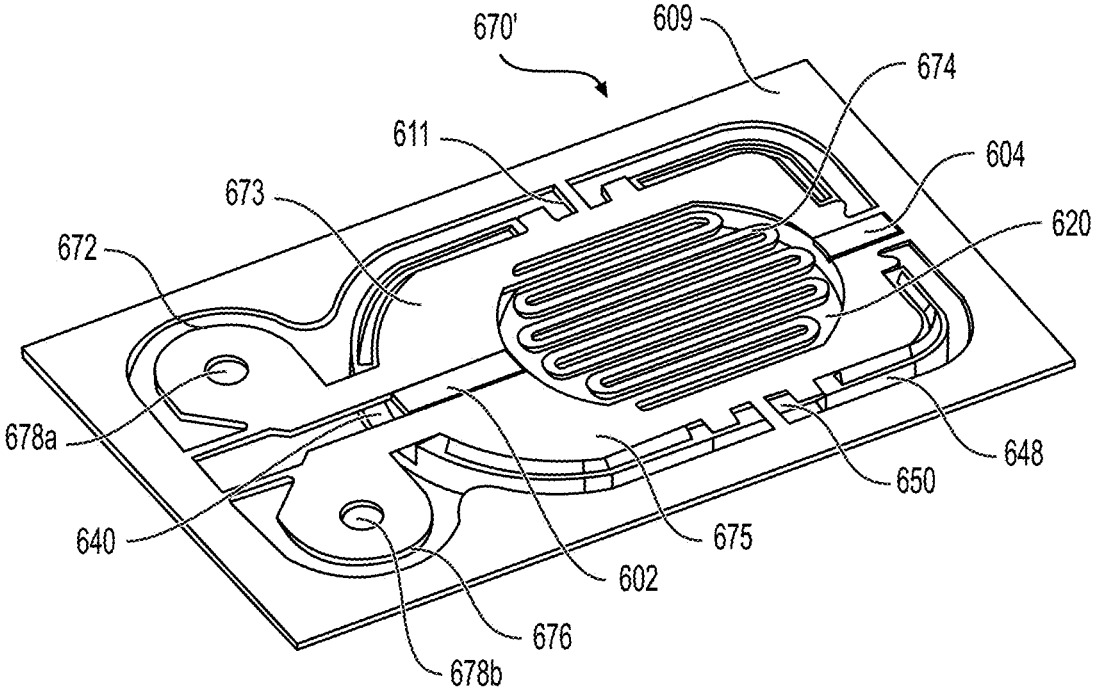
Figure 20:
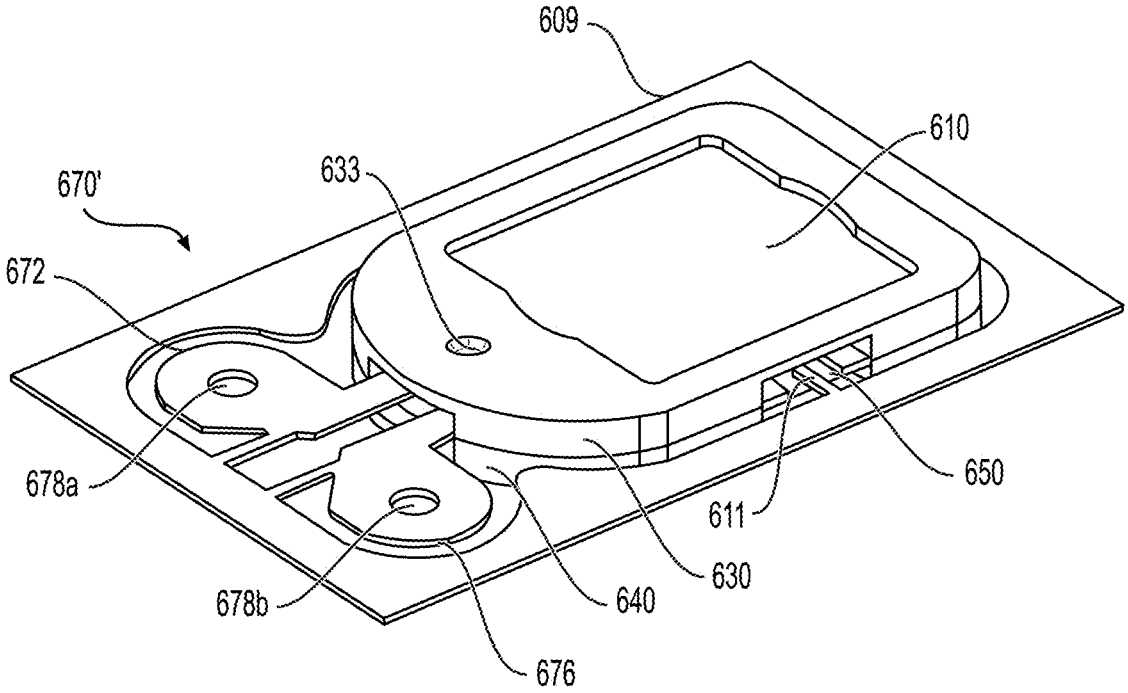

FIGS. 18-20 are perspective views of a method of manufacturing a capsule for an aerosol-generating device according to an example embodiment. Referring to FIG. 18, the partially-assembled capsule may resemble corresponding aspects of the capsule 200 in FIGS. 7-12. For instance, the second permeable structure 620, the second frame 640, and the second connector 648 in FIG. 18 may be as described in connection with the second permeable structure 220, the second frame 240, and the second connector 248, respectively, in FIG. 9. As a result, the relevant disclosures above of the features in common should be understood to apply to this section and may not have been repeated in the interest of brevity.

After the second permeable structure 620, the third frame 650, and an aerosol-forming substrate (not illustrated) are disposed in the second frame 640, the patterned sheet 670' may be positioned such that the intermediate section 674 is aligned with the opening defined by the third frame 650 to hold the aerosol-forming substrate. In an example embodiment, the inner contours of the first arm portion 673 and the second arm portion 675 correspond to the shape and size of the opening defined by the third frame 650. The intermediate section 674 of the heater may be in the form of a pattern that spans over a majority of the open area in the opening of the third frame 650. For instance, the pattern may be such that the intermediate section 674 of the heater oscillates above the opening of the third frame 650. In such an instance, the intermediate section 674 of the heater may alternate between extending toward the proximal end of the second frame 640 and toward the distal end of the second frame 640.

When the second connector 648 of the second frame 640 is separated into four discrete structures (e.g., two elevated trenches and two tapered ridges) as shown in FIG. 18, four spaces are defined therebetween. In an example embodiment, the four spaces include a proximal end space, a distal end space, and two opposing side spaces. During assembly, the patterned sheet 670' is positioned on the second frame 640 such that the external segments of the heater, which includes the first end section 672 and the second end section 676, extend through the proximal end space of the second frame 640. Additionally, the positioning of the patterned sheet 670' is such that the three pairs of alignment tabs on the first arm portion 673 and the second arm portion 675 are seated in the distal end space and the two opposing side spaces. Furthermore, the outer contours of the first arm portion 673 and the second arm portion 675 substantially correspond to the shape and size of the third frame 650 and the interior face of the second frame 640 so as to result in a relatively close fit.

Referring to FIG. 19, a first insert 602 is seated on a proximal portion of the third frame 650 between the first arm portion 673 and the second arm portion 675. In addition, a second insert 604 is seated on a distal portion of the third frame 650 between the first arm portion 673 and the second arm portion 675. In an example embodiment, each of the first insert 602 and the second insert 604 is in the form of a strip (e.g., of silicone) with a thickness that substantially corresponds to the thickness of the patterned sheet 670' and a width that substantially corresponds to the gap between the first arm portion 673 and the second arm portion 675. The first insert 602 and the second insert 604 may also be aligned with the longitudinal axis of the patterned sheet 670', wherein the longitudinal axis bisects the intermediate section 674 and extends (e.g., equidistantly) between the first arm portion 673 and the second arm portion 675. The first insert 602 and the second insert 604 may function as plugs so as to improve an airflow (e.g., orthogonal airflow) through the first permeable structure 610 (FIG. 20) and the second permeable structure 620. Furthermore, the first insert 602 and the second insert 604 may function as insulating spacers so as to prevent or reduce an occurrence of an electrical short circuit.

Referring to FIG. 20, an inner frame defining an opening (e.g., identical to the third frame 650) is disposed on the patterned sheet 670' along with additional aerosol-forming substrate in the opening of the inner frame followed by a first permeable structure 610 and a first frame 630 to enclose, inter alia, the aerosol-forming substrate within. The first permeable structure 610 and the first frame 630 may be as described in connection with the first permeable structure 210 and the first frame 230, respectively, in FIG. 7. In addition, the first concavity 633 may be as described in connection with the first concavity 233 in FIG. 7. As a result, the relevant disclosures above should be understood to apply to this section and may not have been repeated in the interest of brevity. The first frame 630 and the second frame 640 may be connected via a welded arrangement. After the connection of the first frame 630 and the second frame 640, the breakout portions 611 are cut (e.g., die cut, laser cut) to separate the sheet portion 609 from the capsule.

Figure 21:
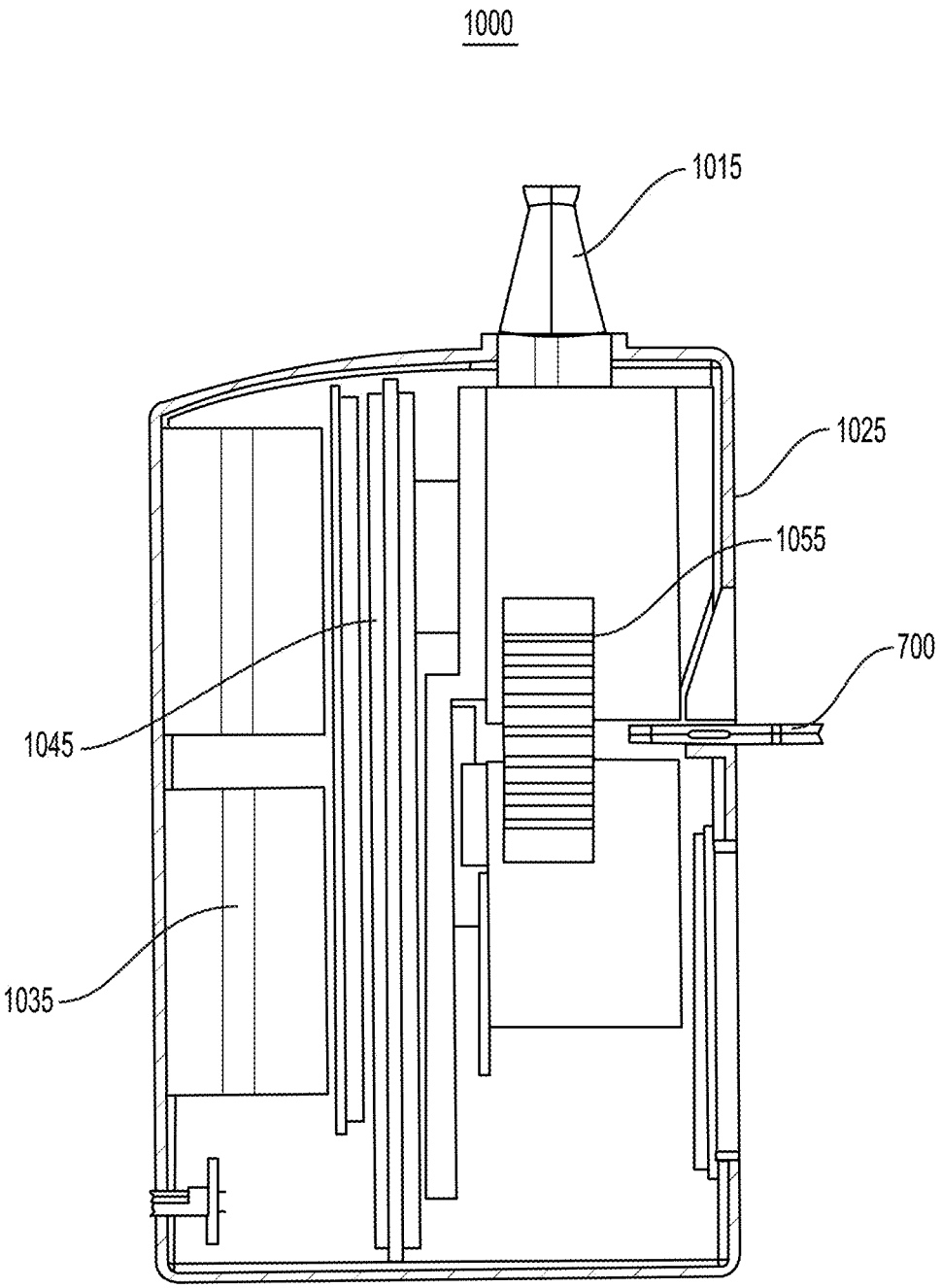
FIG. 21 is a cross-sectional, schematic view of an aerosol-generating device according to an example embodiment.

FIG. 21 is a cross-sectional, schematic view of an aerosol-generating device according to an example embodiment. Referring to FIG. 21, an aerosol-generating device 1000 (e.g., heat-not-burn aerosol-generating device) includes a mouthpiece 1015 and a device body 1025. A power source 1035 and control circuitry 1045 may be disposed within the device body 1025 of the aerosol-generating device 1000. The power source 1035 may include one or more batteries (e.g., rechargeable dual battery arrangement). The aerosol-generating device 1000 is configured to receive a capsule 700, which may be as described in connection with any of the embodiments herein. The aerosol-generating device 1000 also includes an engagement assembly 1055 configured to electrically contact the capsule 700. In an example embodiment, the engagement assembly 1055 includes a first electrode and a second electrode configured to electrically contact a first end section and a second end section, respectively, of a heater of the capsule 700.

When the capsule 700 is inserted into the aerosol-generating device 1000, the control circuitry 1045 may instruct the power source 1035 to supply an electric current to the first electrode and the second electrode of the engagement assembly 1055. The supply of current from the power source 1035 may be in response to a manual operation (e.g., button-activation) or an automatic operation (e.g., puff-activation). As a result of the current, the capsule 700 may be heated to generate an aerosol. In addition, the change in resistance of the heater may be used to monitor and control the aerosolization temperature. The aerosol generated may be drawn from the aerosol-generating device 1000 via the mouthpiece 1015.

Figure 22:
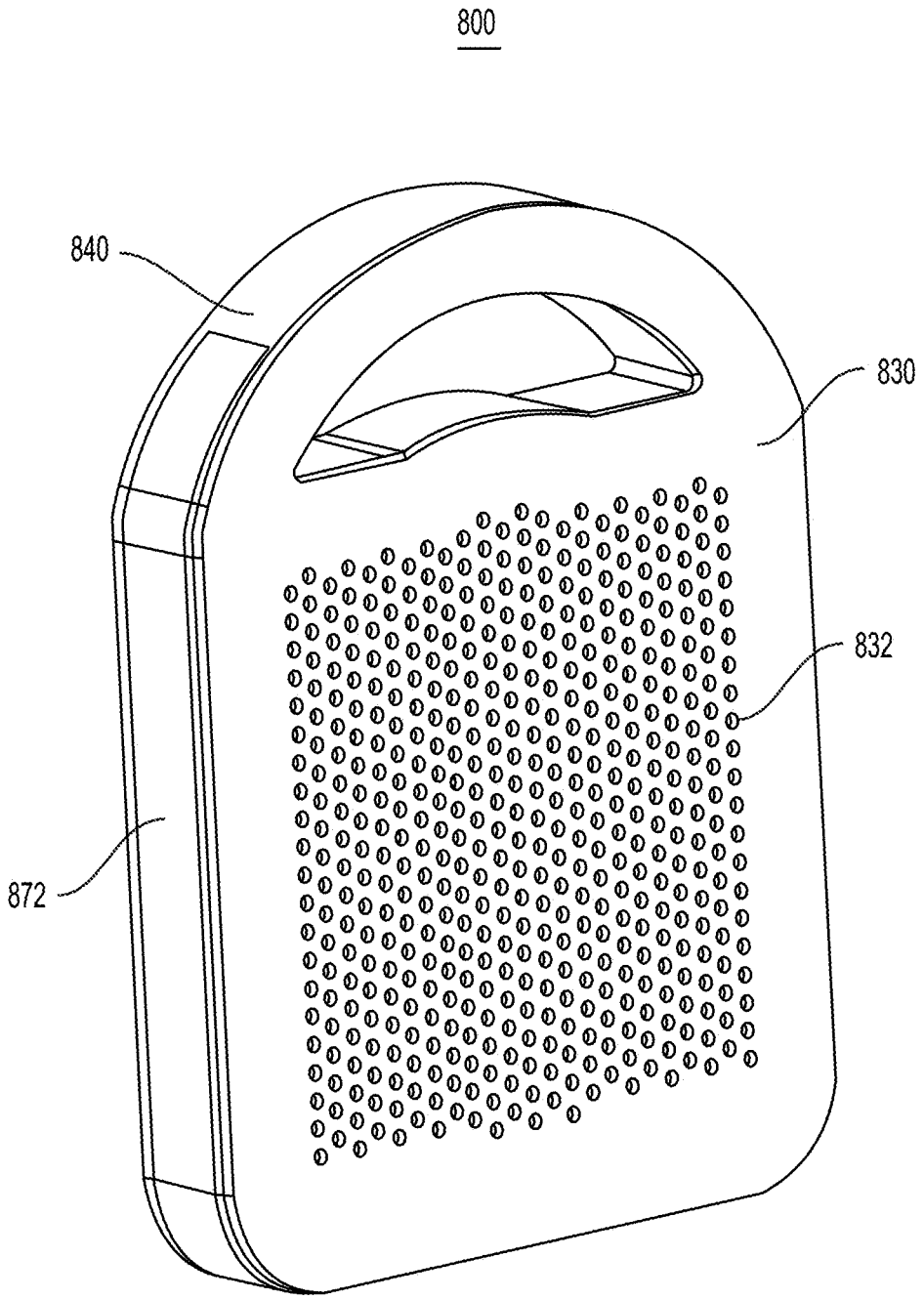
FIG. 22 is a perspective view of another capsule for an aerosol-generating device according to an example embodiment.
Figure 23:
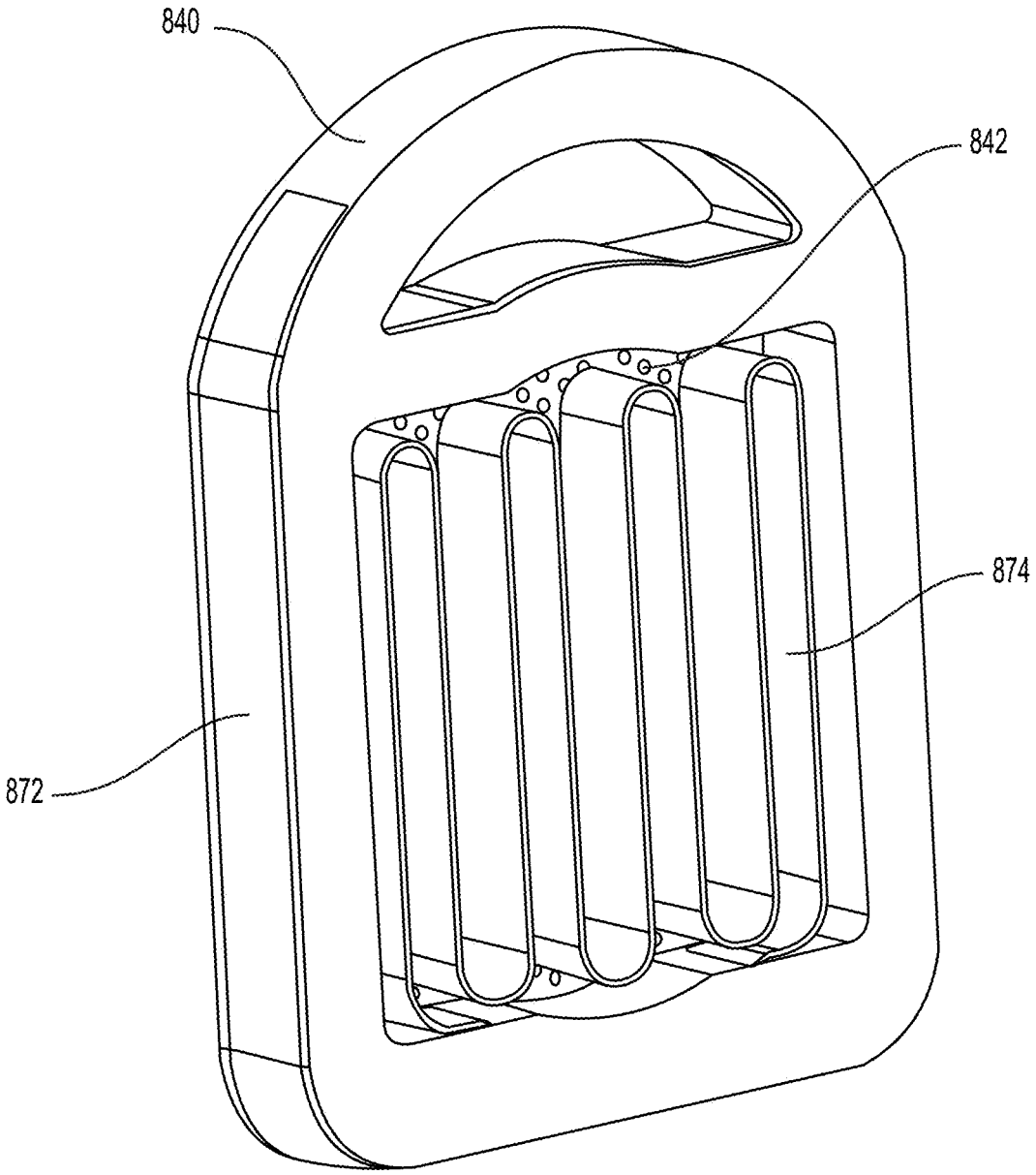
FIG. 23 is an interior view of the capsule of FIG. 22.
Figure 24:
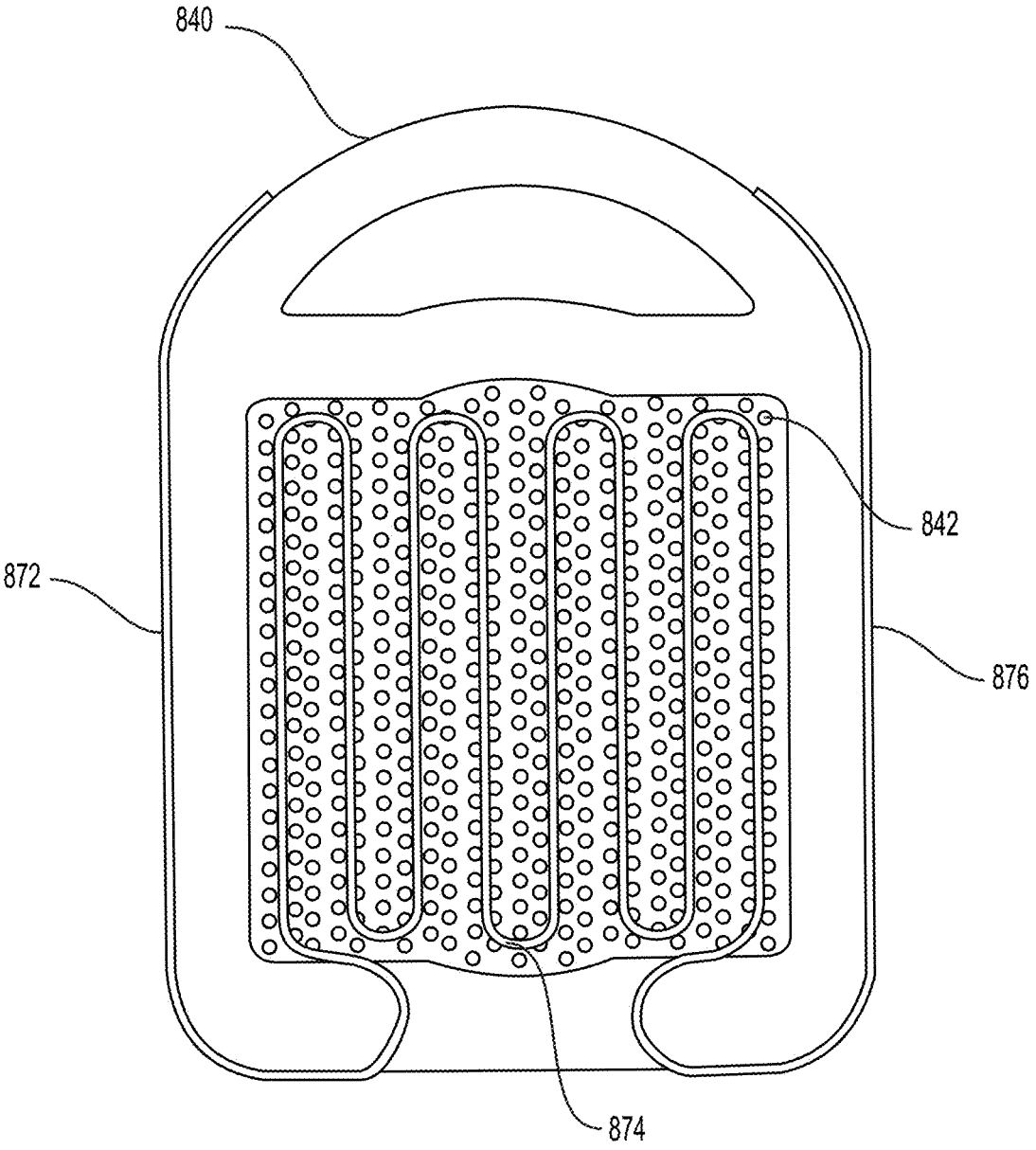
FIG. 24 is a cross-sectional plan view of the capsule of FIG. 22.
Figure 25:
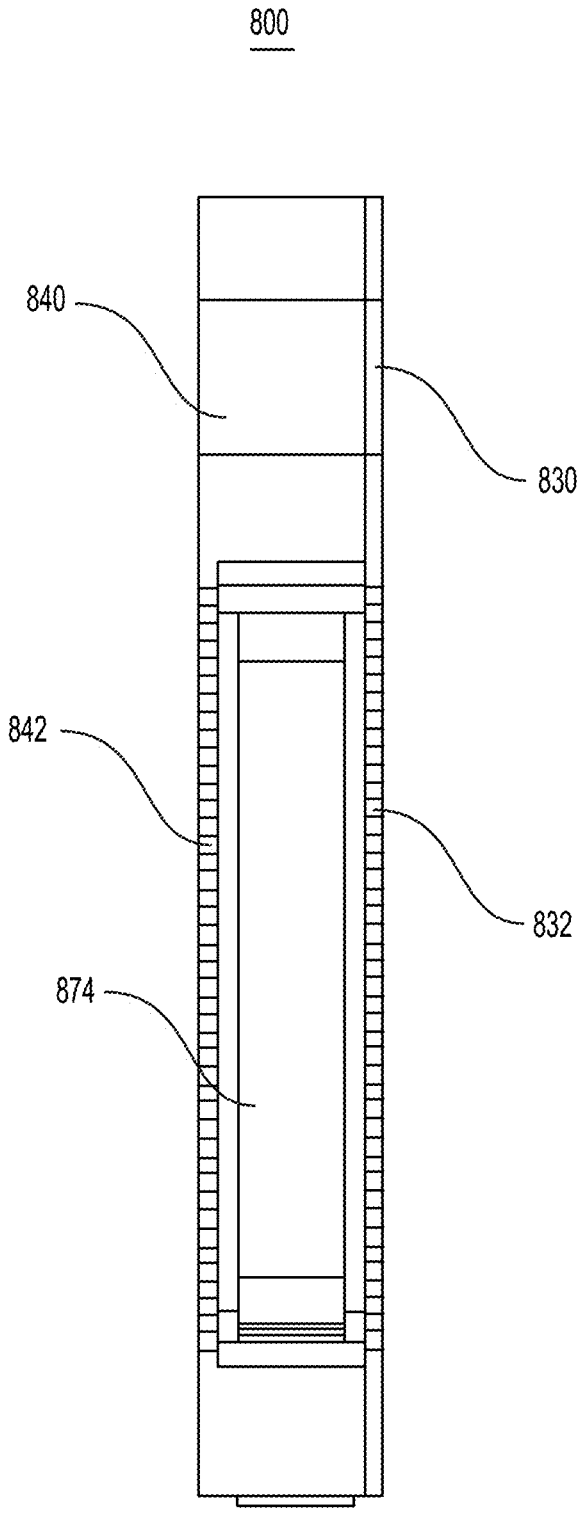
FIG. 25 is a cross-sectional side view of the capsule of FIG. 22.

FIG. 22 is a perspective view of another capsule for an aerosol-generating device according to an example embodiment. FIG. 23 is an interior view of the capsule of FIG. 22. FIG. 24 is a cross-sectional plan view of the capsule of FIG. 22. FIG. 25 is a cross-sectional side view of the capsule of FIG. 22. Referring to FIGS. 22-25, a capsule 800 may be configured to be received within an aerosol-generating device (e.g., heat-not-burn aerosol-generating device). The proximal end (e.g., upper end in FIG. 22) of the capsule 800 may have a curved proximal edge, and the opposing distal end (e.g., lower end in FIG. 22) may have a linear distal edge. In addition, a pair of linear side edges may connect the curved proximal edge and the linear distal edge. The pair of linear side edges may be parallel to each other. Furthermore, the junctions of the linear side edges with the linear distal edge may be in the form of rounded corners.

Although the capsule 800 is shown in the figures as resembling a rectangle with a curved handle, it should be understood that other configurations may be employed. For instance, the shape may be circular such that the capsule 800 has a disk-like appearance. In another instance, the shape of the capsule 800 may be elliptical or racetrack-like. In other instances, the capsule 800 may have a polygonal shape (regular or irregular), including a triangle, a rectangle (e.g., square), a pentagon, a hexagon, a heptagon, or an octagon. The generally planar form of the capsule 800 may facilitate stacking so as to allow a plurality of capsules to be stored in an aerosol-generating device or other receptacle for dispensing a new capsule or receiving a depleted capsule.

The capsule 800 includes a housing and a heater within the housing. The housing of the capsule 800 has interior surfaces defining a chamber configured to hold an aerosol-forming substrate. In addition, the housing of the capsule 800 has exterior surfaces constituting a first face, an opposing second face, and a side face of the capsule 800. The first face and the second face of the capsule 800 may be permeable to an aerosol. The side face of the capsule 800 is between the first face and the second face. The side face may be regarded as a periphery of the capsule 800.

The housing of the capsule 800 includes a first frame 830 and a second frame 840. The exterior surface the first frame 830 may be regarded as the first face of the capsule 800. Similarly, the exterior surface of the second frame 840 may be regarded as the second face of the capsule 800. The first frame 830 and the second frame 840 may be of the same shape and size (e.g., based on a plan view) and aligned such that the outer sidewalls are substantially flush with each other, although example embodiments are not limited thereto. The first frame 830 and the second frame 840 may be formed of a suitable polymer, such as polyether ether ketone (PEEK), liquid crystal polymer (LCP), and/or ultra-high molecular weight polyethylene (UHMWPE). The first frame 830 and the second frame 840 may be connected via a welded arrangement (e.g., ultrasonic welding) or with an adhesive (e.g., tape, glue) that has been deemed food-safe or otherwise acceptable by a regulatory authority.

The second frame 840 may be in the form of a container defining a cavity or containment space. In an example embodiment, the sidewall of the cavity defined by the second frame 840 has opposing linear sections and, optionally, opposing curved sections, wherein one curved section may be adjacent to the proximal end of the second frame 840, and the other curved section may be adjacent to the opposing distal end of the second frame 840. The first frame 830 may be in the form of a lid configured to engage with the second frame 840 so as to close the cavity. The combination of the cavity of the second frame 840 and the corresponding interior surface of the first frame 830 (which covers the cavity) may be regarded as defining the chamber.

As shown in FIG. 22, the first frame 830 defines first perforations 832 coinciding with the cavity of the second frame 840, while the peripheral regions of the first frame 830 coinciding with the rim of the second frame 840 are not perforated. Similarly, as shown in FIGS. 23-24, the second frame 840 defines second perforations 842 in the cavity. The pattern and size of the first perforations 832 may mimic the pattern and size of the second perforations 842 (e.g., staggered and 80, 100, or 250 mesh equivalent), although example embodiments are not limited thereto. The first perforations 832 and the second perforations 842 may be achieved mechanically or chemically (e.g., via photochemical machining/etching).

A heater is disposed within the capsule 800 to heat the aerosol-forming substrate. In an example embodiment, the heater extends through the second frame 840 and into the cavity. For instance, the heater may be embedded within the second frame 840 via injection molding. The heater may be in a form of a ribbon-like strip having a length, a width, and a thickness, wherein the width is a larger dimension than the thickness, and a direction of the width is orthogonal to the first face and the second face of the capsule 800. The heater includes a first end section 872, an intermediate section 874, and a second end section 876. The first end section 872, the intermediate section 874, and the second end section 876 of the heater are sections of a continuous structure. At least the intermediate section 874 of the heater has a winding (e.g., serpentine) form. The winding form of the intermediate section 874 may include a plurality of parallel and evenly-spaced segments (e.g., eight such segments).

The intermediate section 874 of the heater may be in the form of a pattern that spans a majority of the open area in the cavity of the second frame 840. For instance, the pattern may be such that the intermediate section 874 of the heater zigzags within the cavity of the second frame 840. In such an instance, the intermediate section 874 of the heater may alternate between extending toward the proximal end of the second frame 840 and toward the distal end of the second frame 840. As illustrated in FIGS. 23-24, the undulations of the intermediate section 874 of the heater may be in the form of three to four protuberances (e.g., fingers) that do not contact the sidewall of the cavity of the second frame 840, although example embodiments are not limited thereto.

The first end section 872 and the second end section 876 of the heater are external segments configured to receive an electric current from a power source during an activation of the heater. The intermediate section 874 of the heater is an internal segment disposed within the capsule 800 (e.g., within the chamber of the housing containing the aerosol-forming substrate). When the heater is activated, the temperature of the aerosol-forming substrate may increase (by virtue of the aerosol-forming substrate being in thermal contact with the intermediate section 874), and an aerosol may be generated and released through the first perforations 832 and/or the second perforations 842 of the capsule 800.

The combination of sidewalls of the first frame 830 and the second frame 840 may be regarded as the side face of the capsule 800. Additionally, the first end section 872 and the second end section 876 may be external segments of the heater that also constitute parts of the side face of the capsule 800. For instance, as illustrated in FIGS. 23-24, the first end section 872 and the second end section 876 of the heater may extend through the distal end of the second frame 840 and wrap around to the proximal end while conforming to the peripheral contours of the second frame 840, although example embodiments are not limited thereto.

To assemble the capsule 800, the first frame 830 may be connected to the second frame 840 after an aerosol-forming substrate is disposed within the cavity of the second frame 840. The aerosol-forming substrate may be in a loose form (e.g., particles, fibers, grounds, fragments, shreds) that does not have a set shape but rather is configured to fill the spaces between the winding form of the intermediate section 874 of the heater and take on the shape of the cavity of the second frame 840. Based on the ribbon-like form of the heater, the intermediate section 874 may be regarded as forming channels or partitions within the cavity of the second frame 840 for receiving the aerosol-forming substrate. Additionally, as noted supra, the joinder between the first frame 830 and the second frame 840 may be achieved via a welded arrangement or with an adhesive that has been deemed food-safe or otherwise acceptable by a regulatory authority. Furthermore, the outer sidewall of the first frame 830 may be substantially flush with the outer sidewall of the second frame 840 when the capsule 800 is assembled, although example embodiments are not limited thereto. Once assembled, the capsule 800 is difficult or impracticable to open without damaging the first frame 830, the second frame 840, and/or other aspects of the capsule 800. As a result, the capsule 800 is relatively tamper-proof against unauthorized actions by third parties.

In an example embodiment, the heater is configured to undergo Joule heating (which is also known as ohmic/resistive heating) upon the application of an electric current thereto. Stated in more detail, the heater may be formed of one or more conductors and configured to produce heat when an electric current passes therethrough. The electric current may be supplied to the first end section 872 and the second end section 876 of the heater from a power source (e.g., battery) within the aerosol-generating device. Suitable conductors for the heater include an iron-based alloy (e.g., stainless steel, iron aluminides), a nickel-based alloy (e.g., nichrome), and/or a ceramic (e.g., ceramic coated with metal). The intermediate section 874 of the heater may have a resistance of about 0.5-2.5 Ohms (e.g., 1-2 Ohms).

The electric current from the power source within the aerosol-generating device may be transmitted via electrodes configured to electrically contact the first end section 872 and the second end section 876 of the heater when the capsule 800 is inserted into the aerosol-generating device. In a non-limiting embodiment, the electrodes may be spring-loaded to enhance an engagement with the heater of the capsule 800. Additionally, the first end section 872 and the second end section 876 of the heater may provide a relatively large contact surface for the electrodes so as to facilitate a proper and consistent electrical connection. The spring-loading of the electrodes may be in a direction that is orthogonal to the side face of the capsule 800. In addition to or in lieu of the spring-loading, the movement (e.g., engagement, release) of the electrodes may be achieved by mechanical actuation. Furthermore, the supply of the electric current from the aerosol-generating device to the capsule 800 may be a manual operation (e.g., button-activated) or an automatic operation (e.g., puff-activated).

Figure 26:
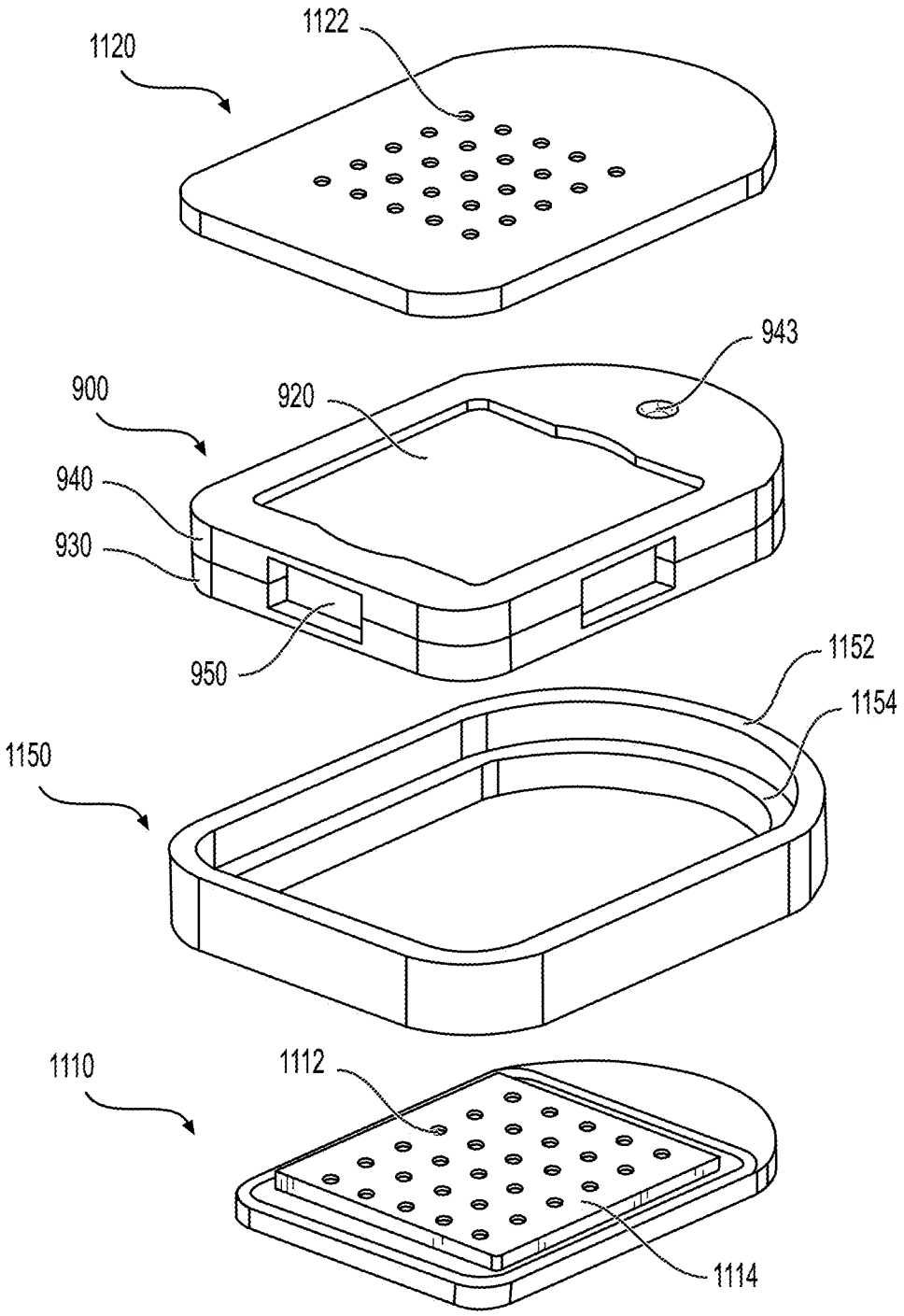
FIG. 26 is a perspective, disengaged view of an engagement assembly for a capsule according to an example embodiment.

FIG. 26 is a perspective, disengaged view of an engagement assembly for a capsule according to an example embodiment. Referring to FIG. 26, an aerosol-generating device may include a device body having an engagement assembly configured to engage a capsule 900 containing an aerosol-forming substrate. The capsule 900 includes a first permeable face, an opposing second permeable face, and a side face. The engagement assembly of the device body may include at least one heating pad configured to heat the aerosol-forming substrate within the capsule 900 via conduction to generate an aerosol. For instance, the device body may be configured to receive the capsule 900 such that the heating pad(s) engages and covers the first permeable face and/or the second permeable face of the capsule 900. In another instance, the engagement assembly of the device body may further include a sealing pad in combination with the heating pad. In such an instance, the device body may be configured to receive the capsule 900 such that the capsule 900 is sandwiched between the heating pad and the sealing pad.

The capsule 900 may resemble corresponding aspects of the capsule 100 and/or the capsule 200 discussed herein. For instance, the first frame 930, the second frame 940, the second permeable structure 920, and the second concavity 943 in FIG. 26 may be as described in connection with the first frame 230, the second frame 240, second permeable structure 220, and the second concavity 243, respectively, in FIG. 8. In addition, the third frame 950 in FIG. 26 may be as described in connection with the third frame 150 in FIG. 2 and/or the third frame 250 in FIG. 8. As a result, the relevant disclosures above of the features in common should be understood to apply to this section and may not have been repeated in the interest of brevity.

The engagement assembly of the device body may include a first pad 1110, a second pad 1120, and/or a holder 1150. The first pad 1110 may include a plateau portion 1114 defining a plurality of first perforations 1112 (e.g., 5×6 array). The dimensions of the plateau portion 1114 of the first pad 1110 may correspond to the first opening in the first frame 930 (through which the first permeable structure is exposed). Although hidden from view in FIG. 26, the first opening and the first permeable structure may be as described in connection with the first opening 231 and the first permeable structure 210 in FIG. 10. The first pad 1110 may also include a raised portion (e.g., sealing ridgeline) surrounding the plateau portion 1114. The height of the raised portion may be less than the height of the plateau portion 1114. As illustrated, the raised portion substantially follows the shape of the plateau portion 1114 and extends along at least the distal and side edges of the first pad 1110, although example embodiments are not limited thereto.

Additionally, while hidden from view in FIG. 26 (but shown in FIG. 28), the second pad 1120 may include a plateau portion defining a plurality of second perforations 1122 (e.g., 5×5 array). The dimensions of the plateau portion of the second pad 1120 may correspond to the second opening in the second frame 940 (through which the second permeable structure 920 is exposed). Although not labeled in FIG. 26, the second opening may be as described in connection with the second opening 241 in FIG. 10. The second pad 1120 may also include a raised portion (e.g., sealing ridgeline) surrounding the plateau portion (as described in connection with the first pad 1110).

The first pad 1110 and/or the second pad 1120 may be formed of silicone or other heat-resistant polymer. In an example embodiment, the first pad 1110 may be a heating pad configured to heat the aerosol-forming substrate within the capsule 900 via conduction to generate an aerosol, while the second pad 1120 may be a sealing pad. In another instance, both the first pad 1110 and the second pad 1120 may be heating pads. When structured as a heating pad, the first pad 1110 and/or the second pad 1120 may include an integrated heating element as known in the art. Furthermore, in some instances, when a heating pad is used to heat the aerosol-forming substrate, the capsule 900 may be one that does not include a heater. Thus, the first pad 1110 and/or the second pad 1120 as a heating pad may function as a primary manner for heating the aerosol-forming substrate within the capsule 900. Alternatively, the first pad 1110 and/or the second pad 1120 as a heating pad may function as a supplemental manner for heating the aerosol-forming substrate within the capsule 900, wherein the primary manner is via a heater (e.g., heater 170) as described herein.

The holder 1150 is configured to receive and support the capsule 900. As illustrated, the holder 1150 includes a rim 1152 and a shelf 1154. The shelf 1154 may extend around an entirety of the lower portion (e.g., bottom half) of the inner sidewall of the holder 1150, although example embodiments are not limited thereto. The shelf 1154 is configured to support the capsule 900 when received within the holder 1150. The holder 1150 may be a stationary or mobile part of the engagement assembly of the device body. When configured as a mobile part, the holder 1150 may be configured to slide (e.g., laterally) outward from the device body to permit the capsule 900 to be seated within the holder 1150.

Figure 27:
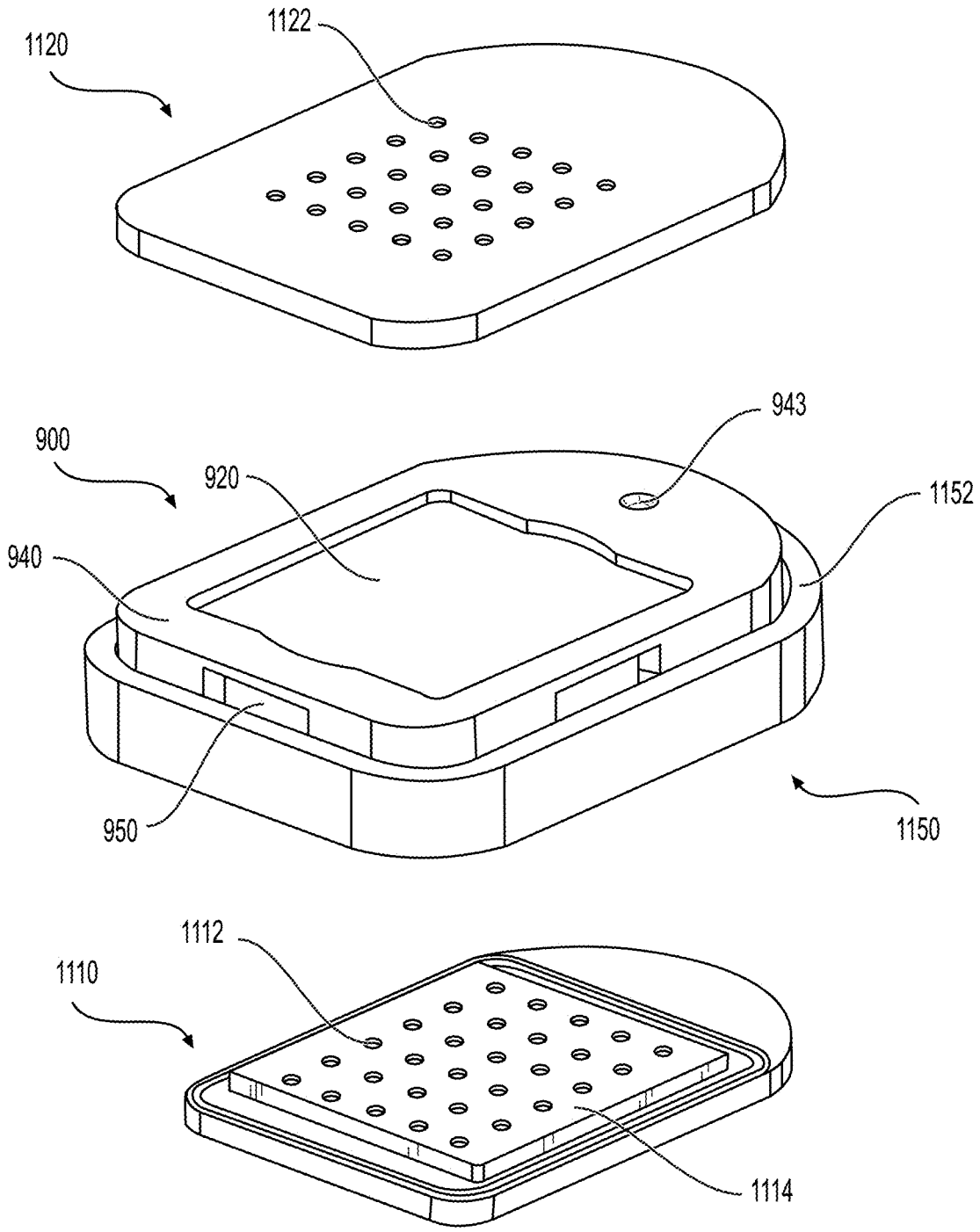
FIG. 27 is a perspective, partially-engaged view of the engagement assembly of FIG. 26.

FIG. 27 is a perspective, partially-engaged view of the engagement assembly of FIG. 26. Referring to FIG. 27, the capsule 900 is partially-engaged with the engagement assembly. In particular, as illustrated, the capsule 900 is received so as to be seated within the holder 1150. In an example embodiment, the opening defined by the holder 1150 corresponds substantially to the shape and size of the capsule 900 (e.g., based on a plan view). As a result, when the capsule 900 is within the opening defined by the holder 1150 and resting on the shelf 1154, there is only a relatively small degree of freedom for movement (e.g., rotation and/or lateral shifting within the plane of the capsule 900). Additionally, the depth of the opening defined by the holder 1150 for the capsule 900 may correspond substantially to the thickness of the first frame 930. The depth of the opening defined by the holder 1150 may be the distance along the inner sidewall from the rim 1152 to the shelf 1154.

Figure 28:
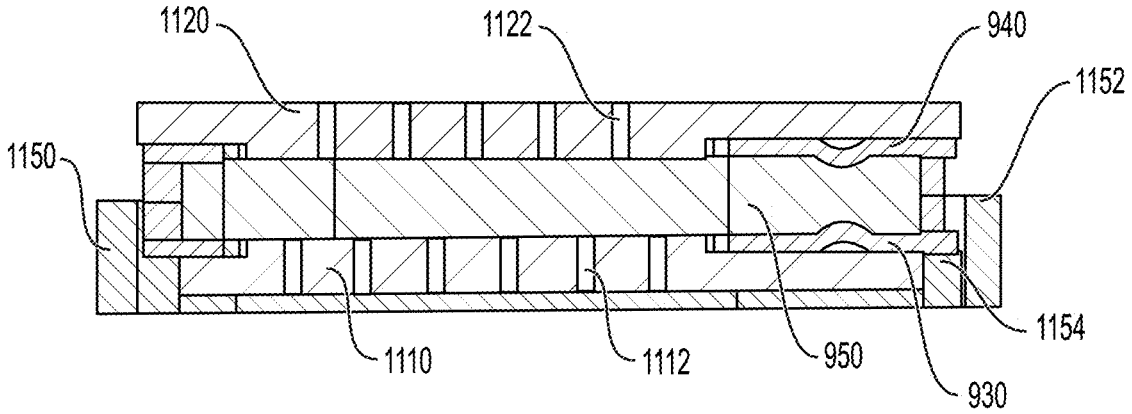
FIG. 28 is a cross-sectional, engaged view of the engagement assembly of FIG. 26.

FIG. 28 is a cross-sectional, engaged view of the engagement assembly of FIG. 26. Referring to FIG. 28, the capsule 900 is fully-engaged with the engagement assembly. In particular, as illustrated, the capsule 900 is supported by the shelf 1154 of the holder 1150 and sandwiched between the first pad 1110 and the second pad 1120. The first pad 1110 and the second pad 1120 may be configured to move in an axial direction (e.g., along the longitudinal axis of the device body) to clamp the capsule 900. In an example embodiment, the plateau portion 1114 of the first pad 1110 interfaces with the first permeable structure of the capsule 900, while the adjacent portion (e.g., including the sealing ridgeline) interfaces with the first frame 930 to establish a seal. Similarly, the plateau portion of the second pad 1120 interfaces with the second permeable structure 920 of the capsule 900, while the adjacent portion (e.g., including the sealing ridgeline) interfaces with the second frame 940 to establish a seal.

The plurality of first perforations 1112 of the first pad 1110 may be staggered or otherwise offset with the plurality of second perforations 1122 of the second pad 1120 when the first pad 1110 and the second pad 1120 engage the capsule 900. In such an instance, air flowing through the plurality of first perforations 1112 and entering the capsule 900 will have a longer dwell time or residence time within the aerosol-forming substrate in the capsule 900 (e.g., compared to a scenario wherein the first perforations 1112 are aligned with the second perforations 1122). The longer dwell time or residence time within the aerosol-forming substrate in the capsule 900 may increase the amount of volatiles entrained by the air flowing therethrough. As a result, the quantity and/or quality of the aerosol leaving the capsule 900 (via the second permeable structure 920) and exiting through the plurality of second perforations 1122 of the second pad 1120 may be improved.

Using the capsules and devices disclosed herein, an aerosol-forming substrate may be heated to generate an aerosol. In an example embodiment, a method of generating an aerosol may include engaging a capsule 900 between a first pad 1110 and a second pad 1120 of an aerosol-generating device. As noted supra, the capsule 900 contains an aerosol-forming substrate and includes a first permeable face, an opposing second permeable face, and a side face. The method may additionally include heating the aerosol-forming substrate with at least one of the first pad 1110 or the second pad 1120 such that the aerosol generated exits a permeable face of the capsule 900 and passes through at least one of the first pad 1110 or the second pad 1120. The aerosol generated may be drawn from the aerosol-generating device via a mouthpiece (e.g., mouthpiece 1015 in FIG. 21). Alternatively, in lieu of or in addition to the external heating by the first pad 1110 and/or the second pad 1120, the aerosol-forming substrate within the capsule 900 may be subjected to internal heating by one or more of the internal heaters disclosed herein.

Further to the non-limiting embodiments set forth herein, additional details of the substrates, capsules, devices, and methods discussed herein may also be found in U.S. application Ser. No. 16/451,662, filed Jun. 25, 2019, titled "CAPSULES, HEAT-NOT-BURN (HNB) AEROSOL-GENERATING DEVICES, AND METHODS OF GENERATING AN AEROSOL,"; U.S. application Ser. No. 16/252,951, filed Jan. 21, 2019, titled "CAPSULES, HEAT-NOT-BURN (HNB) AEROSOL-GENERATING DEVICES, AND METHODS OF GENERATING AN AEROSOL,"; U.S. application Ser. No. 15/845,501, filed Dec. 18, 2017, titled "VAPORIZING DEVICES AND METHODS FOR DELIVERING A COMPOUND USING THE SAME,"; and U.S. application Ser. No. 15/559,308, filed Sep. 18, 2017, titled "VAPORIZER FOR VAPORIZING AN ACTIVE INGREDIENT,", the disclosures of each of which are incorporated herein in their entirety by reference.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A capsule for an aerosol-generating device, comprising:

a housing having interior surfaces defining a chamber configured to hold an aerosol-forming substrate, the housing having exterior surfaces constituting a first face, an opposing second face, and a side face of the capsule, the first face and the second face being permeable to an aerosol, the housing having a first frame, a second frame, and a third frame, the third frame between the first frame and the second frame; and a heater having a first end section, an intermediate section, and a second end section, the first end section and the second end section being external segments constituting parts of the side face of the capsule, the intermediate section being an internal segment disposed within the chamber of the housing.

2. The capsule of claim 1, wherein the first face, the second face, or both include perforated sheets.

3. The capsule of claim 1, wherein the first face, the second face, or both include mesh sheets.

4. The capsule of claim 1, wherein the side face is between the first face and the second face.

5. The capsule of claim 1, wherein the side face is a periphery of the capsule.

6. The capsule claim 1, wherein the third frame defines a cavity.

7. The capsule of claim 6, wherein the heater extends through the third frame and into the cavity.

8. The capsule of claim 6, wherein the third frame is structured as two components configured to engage and clamp the heater therebetween.

9. The capsule of claim 8, wherein the two components define corresponding openings that form the cavity of the third frame.

10. The capsule of claim 8, wherein one of the two components includes a ridged portion, and the other of the two components defines a corresponding grooved portion configured to receive the ridged portion when the two components are engaged.

11. The capsule of claim 10, wherein the ridged portion is between the first end section and the second end section of the heater when the heater is clamped by the two components of the third frame.

12. The capsule of claim 1, wherein the first end section, the intermediate section, and the second end section of the heater are sections of a continuous structure.

13. The capsule of claim 1, wherein the intermediate section of the heater has a planar and winding form.

14. The capsule of claim 1, wherein the intermediate section of the heater has a resistance between 0.5-2.5 Ohms.

15. The capsule of claim 1, wherein the heater is in a form of a ribbon-like strip having a length, a width, and a thickness, the width being a larger dimension than the thickness, a direction of the width being orthogonal to the first face and the second face of the capsule.

16. The capsule of claim 1, wherein the capsule has a thickness between 1-4 mm.

17. The capsule of claim 1, wherein the aerosol-forming substrate includes a plant material.

18. The capsule of claim 17, wherein the plant material includes tobacco.

19. An aerosol-generating device, comprising:

a capsule including, a housing, the housing having, interior surfaces defining a chamber configured to hold an aerosol-forming substrate, exterior surfaces constituting a first face, an opposing second face, and a side face of the capsule, the first face and the second face being permeable to an aerosol, and a first frame, a second frame, and third frame, the third frame between the first frame and the second frame, and a heater having a first end section, an intermediate section, and a second end section, the first end section and the second end section being external segments constituting parts of the side face of the capsule, the intermediate section being an internal segment disposed within the chamber of the housing; and a device body including a heating pad configured to heat the aerosol-forming substrate within the capsule via conduction to generate an aerosol, the device body configured to receive the capsule such that the heating pad engages and covers the first permeable face or the second permeable face of the capsule.

20. The aerosol-generating device of claim 19, wherein the device body further includes a sealing pad, and the device body is configured to receive the capsule such that the capsule is sandwiched between the heating pad and the sealing pad.

21. A method of generating an aerosol, comprising:

engaging a capsule between a first pad and a second pad, the capsule including, a housing, the housing having, interior surfaces defining a chamber configured to hold an aerosol-forming substrate, exterior surfaces constituting a first face, an opposing second face, and a side face of the capsule, the first face and the second face being permeable to an aerosol, and a first frame, a second frame, and a third frame, the third frame between the first frame and the second frame, and a heater having a first end section, an intermediate section, and a second end section, the first end section and the second end section being external segments constituting parts of the side face of the capsule, the intermediate section being an internal segment disposed within the chamber of the housing; and heating the aerosol-forming substrate with at least one of the first pad or the second pad such that the aerosol generated passes through at least one of the first pad or the second pad.

* * * * *